US009530559B2

(12) United States Patent
Benner, Jr.

(10) Patent No.: US 9,530,559 B2
(45) Date of Patent: Dec. 27, 2016

(54) MULTI-TURN ELECTRICAL COIL AND FABRICATING DEVICE AND ASSOCIATED METHODS

(71) Applicant: William R. Benner, Jr., Longwood, FL (US)

(72) Inventor: William R. Benner, Jr., Longwood, FL (US)

( * ) Notice: Subject to any disclaimer, the term of this patent is extended or adjusted under 35 U.S.C. 154(b) by 421 days.

(21) Appl. No.: 14/167,457

(22) Filed: Jan. 29, 2014

(65) Prior Publication Data

US 2014/0209729 A1 Jul. 31, 2014

Related U.S. Application Data

(60) Provisional application No. 61/758,300, filed on Jan. 30, 2013, provisional application No. 61/774,616, filed on Mar. 8, 2013.

(51) Int. Cl.

| | |
|---|---|
| ***H01F 27/28*** | (2006.01) |
| ***H01F 41/06*** | (2016.01) |
| ***H01F 5/02*** | (2006.01) |

(52) U.S. Cl.

CPC ..... *H01F 41/0616* (2013.01); *H01F 5/02* (2013.01); *H01F 27/2823* (2013.01); *H01F 41/071* (2016.01)

(58) Field of Classification Search

CPC ..... H01F 27/2823; H01F 41/073; H01F 2005/022; B29C 53/60; B29C 53/82; B21F 3/04

See application file for complete search history.

(56) References Cited

U.S. PATENT DOCUMENTS

| | | | | |
|---|---|---|---|---|
| 1,408,463 | A * | 3/1922 | Miles | B66D 1/30 242/608.4 |
| 1,555,544 | A * | 9/1925 | Anthony | B66D 1/34 242/587.1 |
| 2,636,523 | A * | 4/1953 | Hammerschlag | A44B 19/42 140/80 |
| 4,267,865 | A * | 5/1981 | Negro | B21F 3/04 140/92.93 |
| 5,237,165 | A | 8/1993 | Tingley | |
| 5,746,382 | A * | 5/1998 | Tsutsumi | A01K 89/0111 242/322 |
| 5,892,312 | A * | 4/1999 | Hazelton | H01F 5/02 310/194 |
| 5,929,736 | A * | 7/1999 | Sakamaki | H01F 27/2823 336/190 |
| 5,941,357 | A * | 8/1999 | Tabuchi | F16D 27/112 192/84.961 |

(Continued)

*Primary Examiner* — Emmanuel M. Marcelo

(74) *Attorney, Agent, or Firm* — Carl M. Napolitano; GrayRobinson, P.A.

(57) ABSTRACT

A coil former provides for restricted cross-over locations for a coil resulting in an optimum wire packing at all points within the coil. The coil former has a first side wall in a spaced relation to an opposing second side wall, wherein a cavity formed between the side walls accommodates multiple turns of wire for forming a coil. A block is fixed between the opposing first and second side walls and has its peripheral wall surface tapered from the first wall surface inwardly toward the opposing second wall surface for preferentially receiving and positioning turns of wire forming the coil.

28 Claims, 30 Drawing Sheets

(56) References Cited

U.S. PATENT DOCUMENTS

| | | | | |
|---|---|---|---|---|
| 6,060,973 | A * | 5/2000 | Kawano | H01F 27/2823 242/437 |
| 6,243,188 | B1 | 6/2001 | Stukalin et al. | |
| 7,384,012 | B2 * | 6/2008 | Burk | A01K 89/0111 242/322 |
| D642,265 | S | 7/2011 | Hastings | |
| 8,284,470 | B2 | 10/2012 | Brown et al. | |
| 2003/0011271 | A1 * | 1/2003 | Takano | H02K 3/522 310/254.1 |
| 2004/0207501 | A1 * | 10/2004 | Souki | H01F 41/082 336/180 |
| 2006/0125590 | A1 * | 6/2006 | Pilniak | H01F 5/02 336/208 |
| 2007/0272346 | A1 * | 11/2007 | Shpik | B29C 53/566 156/171 |

* cited by examiner

MULTI-TURN ELECTRICAL COIL AND FABRICATING DEVICE AND ASSOCIATED METHODS

CROSS REFERENCE TO RELATED APPLICATIONS

This application claims priority to U.S. Provisional Patent Application No. 61/758,300 filed on Jan. 30, 2013 for Multi-Turn Electrical Coil and Associated Methods and U.S. Provisional Patent Application No. 61/774,616 filed on Mar. 8, 2013 for Multi-Turn Electrical Coil and Fabricating Device and Method, the disclosures of which are hereby incorporated by reference herein in their entirety, and commonly owned.

FIELD OF THE INVENTION

This invention generally relates to multi-turn electrical coils and in particular to coils for use in high-performance motors, actuators and antenna applications where coiled wire bundles are used, and to devices where maximum coil density is desired.

BACKGROUND

There are many motor designs which have emerged over the years. Of particular interest is a type of motor whose stator resides on the outside and rotor resides on the inside of the motor structure. Sometimes this is called an "inside runner" since the moving element is on the inside and the stationary part (stator) is on the outside.

In most motors, the electrical-current-carrying conductors are made of copper, so throughout this disclosure, the word "copper" and "turns of copper" are used to describe the makeup of the coil. However, this should not be deemed a limitation, since some motors use aluminum or even silver wire to carry the electrical current. Moreover, it should be understood that the wire used in motors is insulated, so that subsequent turns do not short out with the rest of the coil, and that each turn does not short out to slots in which the turns are placed. In most cases, copper magnet wire is used, which is insulated with varnish, but the insulation can be anything that prevents electrical contact, such as cloth or even oxides.

There is a figure of merit in motor design called the "Motor Constant", which is designated with the letters KM. The Motor Constant is a measure of the amount of torque produced compared with the power (i.e. heat) dissipated during the production of that torque. KM is expressed in terms of Torque per square root of watt, but may also be found by dividing Torque Constant (KT) by the square root of coil resistance. In all motors and actuators, the more copper you can fit into a given area, the greater the KM will be, and thus, in high performance motors, it is always desirable to maximize the amount of copper that is placed into the winding area.

In high performance motors, it is also desirable to effectively remove any heat that is generated by the windings. Coincidentally, the way you do this is also by maximizing the amount of copper that is placed into the winding area.

Copper has almost the highest thermal conductivity of any material, and thus, when turns of copper are placed close to one another, these turns can share the heat and also help to dissipate the heat to the stator material. Material other than copper (such as air or insulation) located in between the turns will dramatically reduce the heat capacity of the motor.

Typical coils are usually wound in a spiral fashion, starting at the inner-most radius, and arranging turns of wire side-by-side (for example from left to right). The number of turns arranged side-by-side establishes the "thickness" of the coil. Coils may have more than one layer, in which case, once all of the turns are arranged side by side for the first layer, this direction must reverse (for example from right to left) while turns are placed side-by-side on the next layer. Additional layers establish the "width" of the coil.

It is typical for the coil to be wound around an object that establishes its interior shape. The interior shape (i.e. the coil's inner radius) may be round, square, oval or practically any convex shape. The object around which a coil is wound may have "side-walls" that determine the thickness of the coil, and help to retain the wire during the winding process. The object around which a coil is wound is often referred to as a "bobbin" or a "coil former." Throughout the rest of this document, we refer to it as the coil former.

Once the coil is wound around the coil former, the coil and its former may result in a single assembly that remains together for the rest of their lives. For example, it is common for coils to be wound around a plastic coil former (bobbin), and then laminations to be inserted around this coil/former assembly to create a transformer. In this case it is clear that the coil and its former remain together after the winding process.

In other coils, the coil former is removed once the coil is wound. This is most often done in what are called "self-supporting coils". In order for a "self-supporting coil" to retain its shape, an adhesive must be used either after the winding process, or even during the process. It is known in the art to use a special kind of magnet wire called "bondable wire", which has an adhesive layer as a part of the wire. Once a self-supporting coil is wound on a former, the bonding layer is activated, either by heat or by solvent or both.

In the field of coil winding, there is a term called "nesting", which refers to the way in which the individual turns of wire are arranged with respect to one another. It is well known that, when using round wire (the most common type) to create a coil, ideal nesting happens when the turns on each layer are wound right next to one another, and the turns on subsequent layers are wound in the groves created by the turns from the previously-wound layer. FIG. 1 illustrates one such structure, wherein numbers identify an individual turn of wire.

As will be further described later in this disclosure, turns of wire are arranged in columns and rows (or "layers"), and in a coil that uses round wire and has generally perfect nesting, the columns are shifted a half wire diameter, from layer to layer. Because of this column shifting, two layers of wire will take up less space than to two wire diameters, as would be the case with the layers sitting right on top of each other. The image in FIG. 1 illustrates a "perfect nesting" of round wire, and it results in the greatest amount of copper being placed into a given area. This is ideal and highly desirable because such coils will have the lowest electrical resistance and also the lowest thermal resistance, since each turn of wire may be in contact with up to six surrounding turns, resulting in optimal sharing of any heat generated. FIG. 1A illustrates how turns on a typical coil may be arranged. The teachings of the invention observe six surrounding turns form the shape of a hexagon, wherein the hexagonal nature of the turns is illustrated with shading, and will be addressed in greater detail later in this disclosure.

With continued reference to FIG. 1A, it can be seen that turns on the bottom of the figure are arranged side by side in columns. Since there are six turns in the figure, the thickness is simply equal to six wire diameters. As additional layers are added to the coil, they will add 0.866 times a wire diameter in the width to the coil.

The coil illustrated with reference to FIG. 1A may be made using a coil former whose side-walls are set to an integer number of turns on the first layer. When this is done, the number of turns on the next layer will be one less than the first layer (five turns in this illustration), followed by a layer with the same number of turns as for the first layer, and the like as turns are added.

There is another possibility, which is to add a half wire diameter to the integer number for the side-wall distance. In this case, the number of turns on each subsequent layer will be as illustrated with reference to FIG. 1B.

The hexagonal arrangement of turns is clearly visible in both cases, and is highlighted by shading some of the turns, by way of illustrative example.

With continued reference to FIGS. 1A and 1B, it can be seen that top and bottom layers are relatively "flat", whereas the left and right sides of the coil as herein presented appear "jagged", due to empty half-turns of wire on the left and right sides of the coil.

There is another possible way to arrange the turns of wire that results in an opposite scenario, wherein the left and right sides form relatively "flat" surfaces, and the top and bottom sides appear somewhat "jagged" due to the empty half-turn areas. This is illustrated with reference to FIG. 1C. By way of example, such an arrangement of turns may be desirable for thin coils and coils where heat must be removed from the left and right sides of the coil. Unfortunately this type of coil is not easily created using conventional winding techniques. During the typical winding process, as a coil is being wound in a conventional spiral manor, placing turns of wire from left-to-right on one layer, followed by right-to-left on the next, makes it difficult indeed to arrange the left-to-right turns to stagger upward and downward. Thus, the conventional coil winding process is limited in this regard.

While taking another look at the two possible ways of arranging turns of wire in which the hexagonal patterns exist, it is to be observed that there is a constant angular relationship of the turns, and of the hexagon. For conventional coils described above, whose turns are arranged to result in a relatively "flat" bottom and top, this relationship puts the angle at 150 degrees with respect to the side wall, as illustrated with reference to FIG. 1D.

By way of further teachings for the alternative coil described above, whose turns are arranged to result in a relatively "flat" left and right side, this relationship puts the angle at 120 degrees with respect to the side wall, as illustrated with reference to FIG. 1E.

With respect to the illustrations above, it is common for coil formers to have a flat "bottom". That is, all turns on the inner-most radius of the coil are arranged on the same axis and at the same radius. Because of this, if it is desired to create a self-supporting coil, it may be difficult to remove the coil former after the winding process is complete. As turns of wire and layers accumulate, inward forces from each turn press inward on the interior of the former, essentially gripping it. Release agents can be used to aid in removal of the coil from its former, but it would still be more desirable if the coil became separated from the former more easily.

Although the figures discussed above, by way of example, show a cross sectional view of one part of the coil, the degree of nesting cannot be maintained all the way around the entire circumference of the coil. The reason is because the groves formed by the turns on each layer are essentially two-dimensional groves. Sooner or later, at one location around the circumference or another, the turns from each layer must "cross-over" turns from the previous layer.

At the locations where the turns cross-over, there is no longer a space advantage in terms of the reduction in space needed for two layers. At the cross-over locations, the space required truly equals two wire diameters. Likewise, there is no longer the same degree of thermal conductivity at the cross-over locations either, since the contact area, insomuch as the number of places where one turn is in contact with another turn is reduced.

In a most optimal case, all cross-over locations can be restricted to a single location in the wound circumference of the coil. When coils are wound in a typical spiral fashion, where the first turn is located at the inner-most radius of the coil and last turn is located at the outer-most radius, this type of coil winding technique is known as "ortho-cyclic winding."

Ortho-cyclic wound coils are typically rare indeed because the machines that make them are very specialized, and because such coils must be wound very slowly and precisely. Yet further, for general-purpose applications, the level of copper packing and thermal conductivity are not needed, and thus, the additional cost and time associated with ortho-cyclic coils is avoided.

It is far more often for coils to be "random-wound" or "scramble-wound," where the cross-over locations appear at randomized locations along the winding circumference. For coils that do not have round interiors, but instead have angles and straight spans, the reduced tension along the straight span coupled with the length of the span will usually allow the cross-over locations to fall along these spans instead of at the curved corners. This is why coils, which start out having angular or non-round interiors, will often wind up having more rounded exteriors.

Since many cross-over locations will fall along the long spans, one effectively ends up with cross-over locations on top of other cross-over locations until the entire exterior is round, at which point the tension is spread evenly along the entire circumference. After that, randomization of the cross-over locations will keep the coil exterior round, as illustrated with reference to FIG. 2.

There is another drawback to conventional coil winding as well as to ortho-cyclic wound coils. Both types start their winding process at the inner-most radius of the coil, and essentially form a spiral outward, as each layer of the coil is added. Thus, one of the coil's lead wires exists on the inside of the coil and the other coil's lead wire exists on the outside. The two separate locations for lead wires may be disadvantageous in circumstances where both lead wires need to be connected on the outside radius of the coil, because in order for the inner-wire to reach the outer circumference, it will need to be lead-out along the side-wall of the coil, effectively adding another wire diameter to the thickness of the coil.

For motors that use a slotted stator, the coils are most often "race-track-shaped," with the long portion of the coil contained within the slots, and the turn-around areas being folded over the outside of the slots. These turn-around areas are called "end-turns," as illustrated with reference to FIG. 3.

When creating a coil to be placed into slots, the coil can be created in several different ways. In low-performance motors and actuators, coils are most often "scramble wound". As mentioned above, with a "scramble wound" coil, the turns that cross-over from column to column will be located at random locations around the winding circumference. Because of this, there will be many areas within the coil which are filled with material other than copper, such as air or insulation, which will exist in the areas where turns are crossing over each other. The randomized cross-over locations will require the coil to be wider, thus diminishing the amount of copper placed into the slots, and also diminishing the heat capacity of the coil due to the random air locations within the coil.

As described above, ortho-cyclic wound coils, coils having restricted cross-over locations, may be used in an effort to maximize the amount of copper within the coil, by restricting the cross-over locations to only a single area of the winding circumference. However, although the cross-over locations may be located in only a single place, the width of the coil will tend to bulge out at the area where cross-over points exist, as illustrated with reference to FIG. 4.

As illustrated with continued reference to FIG. 4, all of the turns are perfectly nested all the way around the circumference of the coil, except at the left/bottom side in this illustration, where all of the cross-over locations reside. This clearly demonstrates that at the cross-over locations the coil must bulge outward (thus the width of the coil must increase) because where wires cross over each other, there is no space advantage. It is clearly observed that the coil begins in the inner-most radius, and forms an outward spiral ending on the outside.

Because of the bulging outward, this necessitates that the outside diameter of the motor be made large enough to accommodate the bulged coil area.

There is another downside to ortho-cyclic coils. Since the cross-over locations effectively contain a lot of air, due to the spacing between turns, the thermal conductivity and heat sharing is dramatically reduced in the cross-over area of the coil. For a high-performance motor, this could impose a performance limit far below the rest of the coil.

By way of example for a motor, actuator or other device that can use a coil having only two columns, another type of coil-winding technique may be used, such as described in U.S. Pat. No. 5,237,165 to Tingley, III for Multi-Turn Coil Structure and Methods of Winding Same, wherein this type of coil places the turns in a side-by-side fashion, and winds both coils on a coil former at the same time. Since both left-half and right-half of the coil are wound at the same time, turn numbers are identified as 1L and 1R for turn number one on the left and right sides respectively; 2L and 2R for turn number two on the left and right sides respectively, etc. In this construction, the windings are crossing over at many points due to the dual-spiral approach, and because of this, the overall width of the coil is equal to two wire diameters. This results in coil packing as illustrated with reference to FIG. 5. While this type of coil will not have any areas that bulge outward, such as that found in an ortho-cyclic coil of FIG. 4, the downside is that with the side-by-side winding, there is an undesirable amount of air inside the coil.

FIG. 6 illustrates a comparison between a two-column coil wound in a side-by-side fashion to an ortho-cyclic two-column coil. As illustrated, the two-column coil is twice as wide as a single wire diameter, but the ortho-cyclic-wound coil is 1.866 times as wide as a single wire diameter. The thickness difference doesn't seem like much of a difference, but with the side-by-side coil, you can see large square-shaped areas that are not filled with copper, as opposed to small, triangular-shaped areas in the case of ortho-cyclic winding. It is clear that a larger space is required for the side-by-side type of coil.

The ortho-cyclic technique absolutely requires that the first layer of turns (or first few layers for coils that are relatively thin) be placed perfectly, thus creating groves for the following layers. Also, the points at which one turn is complete and the next turn begins must be managed very carefully, to help guide the cross-over locations of layers that follow.

Thus, to aid the ortho-cyclic winding process, a new type of coil former is needed that helps to establish desirable locations of the first few layers of coils, and helps to manage the cross-over locations. Moreover, for coil formers that are separated from the coil after winding (by way of example for creating self-supporting coils), it is desirable for the coil former to be easily separated from the coil, as will be illustrated for embodiments herein described according to the teachings of the present invention.

To restate a problem, ortho-cyclic coils are typically difficult to wind, but they do allow maximum copper density almost all around the winding circumference, except at the cross-over location, where the coil dramatically bulges outward. Side-by-side coils do not have any places around the coil where the coil bulges outward, but there is a reduced copper density at all points around the coil, and also minimized wire-to-wire contact, which in turn minimizes thermal conductivity and heat sharing within the coil. And finally, scramble-wound coils cannot be used for very high performance applications.

There is a need for a new type of coil that is easier to wind than typical ortho-cyclic coils, and allows a high copper packing density of ortho-cyclic coils without a dramatic bulging associated with the coils at cross-over locations.

SUMMARY

With the foregoing in mind, the teachings of the present invention provide devices and methods satisfying needs in the industry for providing desirable coils. One embodiment of the invention includes a coil former that does not have a "flat bottom" portion for the coil, but rather has an angled bottom surface (i.e. angled inner radius) relative to side walls. This angled bottom may be created via a conical feature, by way of non-limiting example.

One embodiment may comprise a coil former comprising a first side wall in spaced relation to an opposing second side wall, wherein a cavity is formed therebetween and dimensioned for receiving multiple turns of wire for forming a coil therein, and a block fixed between the opposing first and second side walls, wherein a peripheral wall surface of the block is tapered from the first wall surface inwardly toward the opposing second wall surface.

One embodiment of the invention may comprise a coil that is ortho-cyclic in nature in that cross-over locations may be restricted to a single area of the winding circumference. Maximum copper packing may thus be achieved at all other points.

A method aspect of the invention may comprise forming a coil using a coil former having a first side wall in spaced relation to an opposing second side wall, wherein a cavity is formed therebetween and dimensioned for receiving multiple turns of wire for forming the coil therein, and a block fixed between the opposing first and second side walls, wherein a peripheral wall surface of the block is tapered from one end to an opposing end thereof and from the first wall surface inwardly toward the opposing second wall surface, wherein the method comprises providing a single strand of wire; folding the strand of wire around one tapered end portion of the block while leaving first and second ends of the strand of wire extending outwardly from the cavity; placing tension on the strand of wire and biasing the strand of wire against the one end of the tapered block; winding the first end of the strand of wire counterclockwise toward the block opposing end to place the first end of the strand of wire against an inner most tapered portion of the block so as to form turn one of the coil; winding the second end of the strand of wire clockwise toward the block opposing end at least one revolution and stopping proximate the opposing end of the block, thus establishing turn two of the coil and a first layer for the coil; again winding of the first end of the strand of wire counterclockwise one revolution around the block, wherein the first end of wire crosses over the second end of the strand of wire proximate the opposing end of the block; continuing to wind the first and second ends of the strand of wire in alternating counterclockwise and clockwise manner until a preselected number of turns is reached.

The teachings of the present invention are well suited for stators that have slots cut into an inside diameter, and where these slots hold turns of electrical-current-carrying conductors. One embodiment may include a slotted stator, by way of example.

Further, the teachings of the present invention provide for a desirable coil winding having multiple columns of wire. By way of example, coils having two to four columns will be desirable for both motors and antennas, such as used in RFID devices.

BRIEF DESCRIPTION OF THE DRAWINGS

Embodiments of the invention are described by way of example with reference to the accompanying drawings in which.

DETAILED DESCRIPTION OF EMBODIMENTS

The present invention will now be described more fully hereinafter with reference to the accompanying drawings, in which embodiments of the invention are shown by way of illustration and example. This invention may, however, be embodied in many forms and should not be construed as limited to the embodiments set forth herein. Rather, these embodiments are provided so that this disclosure will be thorough and complete, and will fully convey the scope of the invention to those skilled in the art.

One embodiment of the invention, herein described by way of example, includes a coil that is ortho-cyclic in nature insomuch that cross-over locations are restricted to a single area of the winding circumference, and that maximum copper packing is achieved at all other points. Distinctions over known structures and methods include a coil former and associated winding method as well as resulting coils. Optional embodiments include a distinction in how the cross-over is accomplished.

Like the side-by-side coils described in U.S. Pat. No. 5,237,165, a single piece of wire is treated like two strands of wire, whose winding process starts in the center, and then spirals outward. However, unlike the well-known coils described in the '165 patent, the two strands are not wound at the same time. Instead, each strand is wound in an alternating fashion. To aid in coil winding, one embodiment of a coil former is created that does not have a flat bottom (coil inner radius) but rather the inner radius of coil former is angled which establishes the relationship of the first few turns of wire, up to the first few layers, and where all other turns and layers follow the initial relationship. One resulting coil is illustrated with reference to FIG. 7, by way of example, and in FIG. 8 illustrating a portion of the coil in a coil former.

Figure 7:
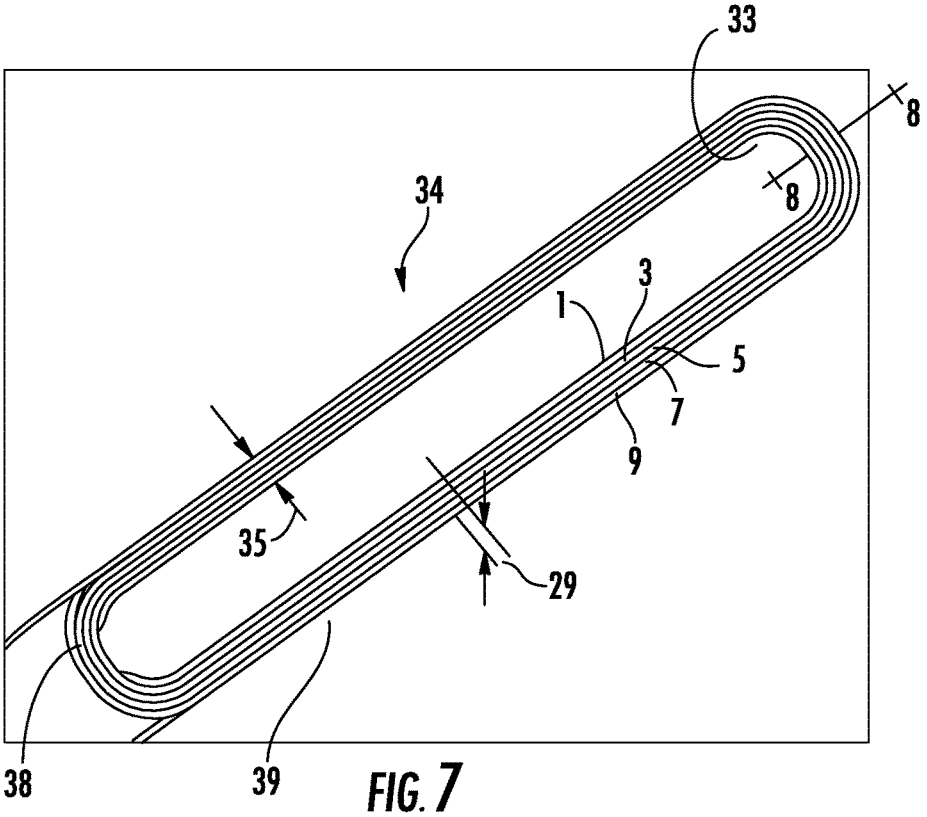
FIG. 7 illustrates an electrical coil formed according to the teachings of the present invention.
Figure 8:
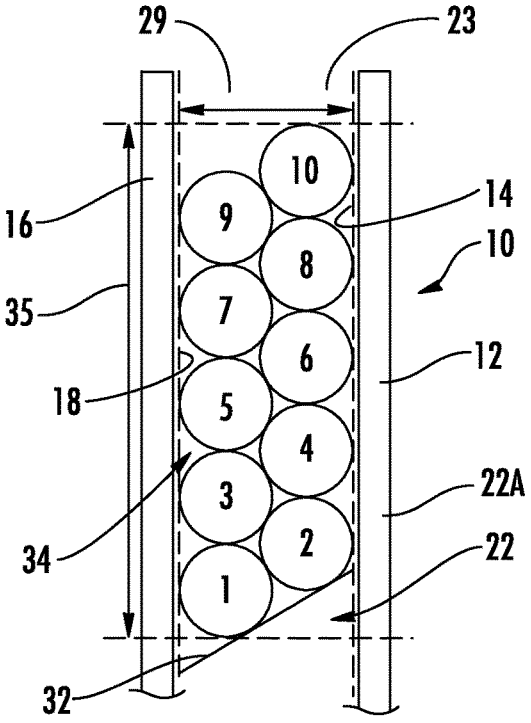
FIG. 8 illustrates one ortho-cyclic coil cross sectional view taken through lines 8-8 in FIG. 7, wherein two columns are offset by a half wire diameter.

With continued reference to FIGS. 7 and 8, the coil former is herein described as including plates that form side walls. The distance between the side walls establishes the thickness of the coil. For ortho-cyclic coils with two columns illustrated with reference to FIG. 8, the distance between the side-walls of the coil former is set to 1.866 times the diameter of a single wire used to form the coil. For the two-column, ortho-cyclic coil, the two columns are effectively shifted by a half wire diameter.

When winding the coil like the one illustrated in FIGS. 7 and 8, the position (effectively the winding circumference) of the first few turns is important and in fact, for a two column coil as illustrated in FIGS. 7 and 8, the first turn is important in that if a location of the first turn is established reliably, all other turns will follow in a desired manner.

To aid in the establishment of the first few turns, one coil former embodiment of the present invention has an angled portion on an inner block that forces the first turn to fall into an optimal position for coil winding. This angled feature may be a smooth angled surface (smooth conical surface as herein illustrated with reference to FIG. 9) or it may be a stepped angled surface. The angle places the first layer in a desired location within the coil. Because of the presence of this angled feature, the first turn is forced into a position that has the smallest winding circumference (basically the inner-most diameter of the coil), as illustrated with reference again to FIGS. 8, 9 and 10.

For self-supporting coils, there is another benefit to having the angled feature of the coil former be conical or tapered inwardly toward the removable plate (a smooth angled surface rather than a stepped surface). After the coil is formed and its shape is retained with adhesive, the coil must be removed from the former. For conventional coil formers that have a flat bottom, there is a lot of inward force caused by the tension of the winding process. This force makes it difficult to remove the coil from the former. However, when the coil former has the angled feature, there is no inward force holding it onto a flat bottom. Thus, the coil is easily removed from the former. Because of this, the smooth conical shape is a desirable shape for the angled feature, although other shapes will work, as long as they force the first few turns of wire to the inner-most diameter of the coil.

For the two-column coil above described and illustrated with reference to FIG. 8, which arranges turns of wire so that the left and right sides of the coil are relatively flat, the angled feature may have an angle of 120 degrees with respect to the side-wall and thus, in addition to the first turn being forced to the inner-most perimeter, the second turn will also ride on outer perimeter of the conical shape. Thus, the conical shape helps to establish the location of the first two turns (turn 1 and turn 2 as illustrated). For coils having a different number of rows and columns, a different angle may be used. This is described in greater detail below.

Figure 9:
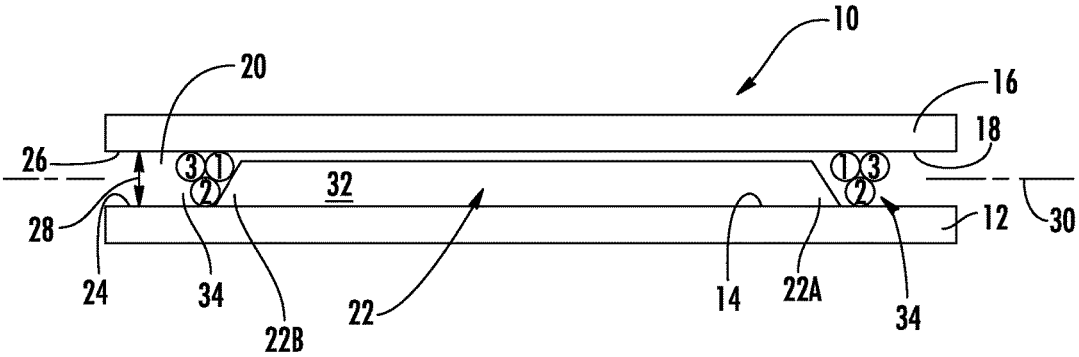
FIG. 9 is side elevation view of a two-piece coil former according to the teachings of the present invention.

With reference to FIGS. 7, 8 and 9, by way of example, one coil former 10, according to the teachings of the present invention comprises a first plate 12 having a first side wall 14 and a second plate 16 having a second side wall 18 which opposing the first side wall so as to form a cavity 20 therebetween. A block 22 is positioned within peripheries 24, 26 of and between the first and second plates 12, 16 for fixing a separation 28 between the opposing first and second side walls 14, 18. This separation 28 establishes a thickness 29 for the coil 34. While not intended to be a limitation, for coils being fabricated herein by way of example, the block 22 and plates 12, 16 are elongate and the block is fixed generally along a long axis 30 of the coil former 10. A peripheral wall surface 32 of the block 22 extending from the opposing side walls 14, 18 is tapered inwardly from the first side wall 14 toward the opposing second wall 18, a conical shape for the embodiment herein illustrated by way of example. Depending upon the structure of the coil former 10, the taper may be stepped, and may be tapered from the second to the first side walls when a removable block is used. For the illustration herein presented, the block 22 is described as having one end 22A and an opposing end 22B, wherein the one end (herein referred to a top end 23 for convenience) is illustrated in cross section by way of non-limiting example throughout the description as presented in cross section 8-8 of FIG. 7. While not intending to be a limitation, an area of greater spacing 36, herein shown at a bottom end 37 of the coil former 10 provides a place for crossovers 38 of the coil 34 proximate the opposing end 22B, the bottom end 37 as herein described. For the embodiment herein presented by way of example, the tapered block 22 includes a truncated conical shape for its wall surface 32, as illustrated with reference to FIG. 10. During fabrication of any coils 34, or as later presented in this disclosure by way of non-limiting example, the plates 12, 16 are rigidly fixed to the block 22.

Figure 10:
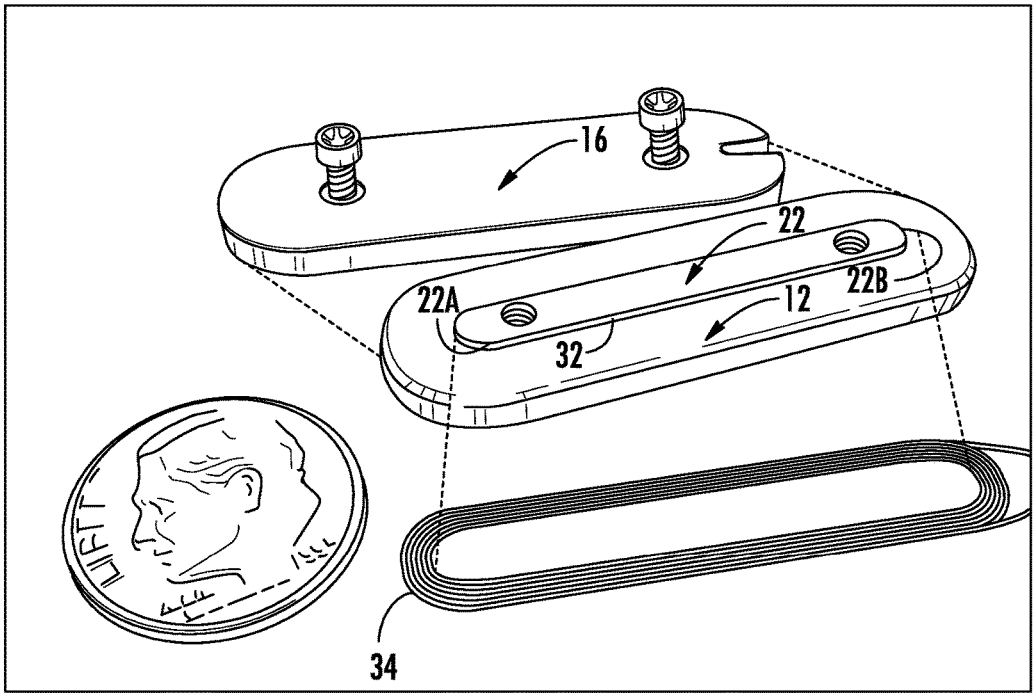
FIG. 10 is includes perspective views of first and second opposing plates of the coil former of FIG. 9, a coil formed by the coil former and a US dime illustrating a relative size of one embodiment, by way of non-limiting example.
Figure 10A:
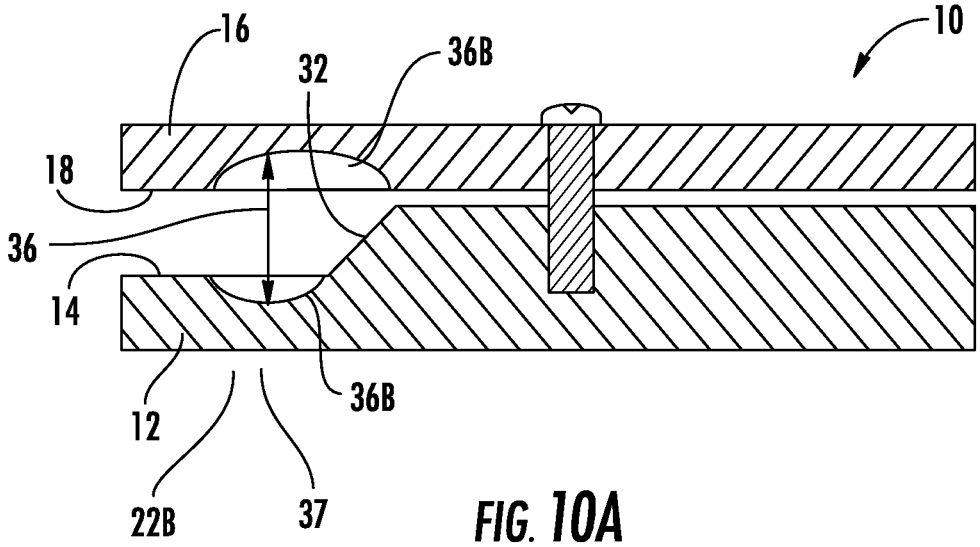
FIG. 10A is a partial cross sectional view of one end of a coil former having an area of greater spacing between plates.

With continued reference to FIGS. 9 and 10, for the embodiment of the coil former 10, herein described by way of example, the block 22 is integrally formed with first plate 12. Generally, the spacing or separation 28, thus coil thickness 29, between the opposing side walls 14, 18 is uniform along the length of the coil former 10. For forming a two column coil, as above described with reference to FIG. 8, the area of greater spacing 36 is provided between the opposing side walls 14, 18 proximate the bottom end 37 of the coil former 10 providing sufficient increased spacing, as illustrated with reference to FIG. 10A, for accommodating the crossovers 38 of the coil 34 being formed between the opposing side walls, as illustrated with reference again to FIG. 7. While not intended to be a limitation, those of skill in the art will appreciate the coil former 10 herein described by way of example for producing coils 34 of varying sizes, as illustrated with reference again to FIG. 10, including a US dime herein used as a size reference.

By way of example, one embodiment of the coil former 10 may be made in three pieces including a left-side-wall (second side wall 18 of FIG. 8), a right-side-wall (first side wall 14 of FIG. 8), and the inner block 22 having the conical shape above described, by way of example. Optionally, the coil former 10 may be made in two pieces, as illustrated with reference again to FIGS. 9 and 10, where the block 22 forming the inner-circumference and establishing the angled (tapered) feature is integrated into one of the plates 12, 16 forming the side-walls 14, 18, wherein removing the opposing plate allows the formed coil 34 to be easily removed as above described.

Figure 11:
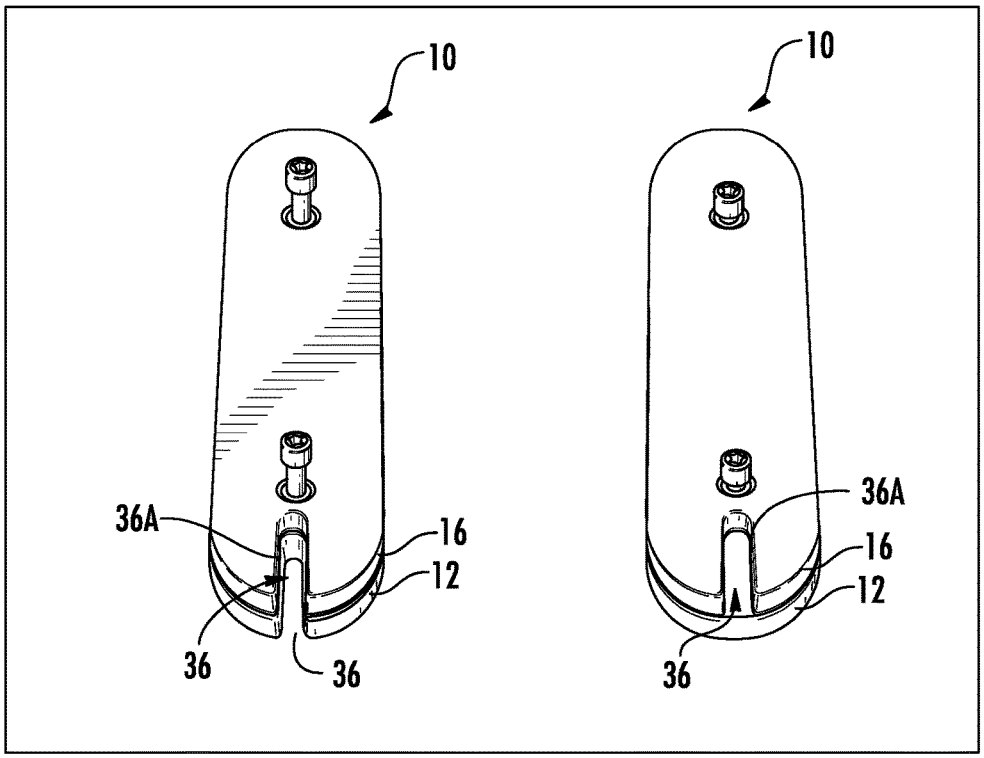
FIG. 11 illustrates alternate embodiments of a coil former according to the teachings of the present invention, wherein the coil former illustrated on the left includes slots formed in the top and bottom plates to provide areas of greater spacing, and wherein the coil former illustrated on the right includes the slot cut into one plate.

Unlike known coil formers, for the type of coils herein described and illustrated by way of example, one or both side-walls may have an area of greater spacing (i.e. greater thickness) where the spacing between the side-walls (which establishes the thickness of the coil) becomes greater than the 1.866 nominal thickness required for a two-column coil shown in FIG. 8. The area of greater spacing 36 may be a cut-out slot 36A in a plate 12, 16 or implemented as channels 36B ground into the side-walls, as illustrated with reference to FIGS. 10A and 11. As above described, the area of greater spacing 36 is where the crossovers 38 can reside on some coils, such as the two column coil of FIGS. 7 and 8, wound using the method of the current invention.

As illustrated with reference again to FIG. 11, the coil former 10 on the left side of the illustration comprises a top and bottom machined coil former with a slot cut into both the top and bottom side-walls. The coil former 10 on the right is similar in structure except for the slot cut only into the top side-wall.

As illustrated earlier with reference to FIGS. 7 and 8, it will be helpful to review elements of the coil 34 and coil former 10 and consider the layers being formed, herein designated by numerals 1, 2, and the like, being consistent between FIGS. 7 and 8. By way of example of a method for winding the coil 34, using the coil former 10, and with reference now to FIGS. 12, 12A and 12B, the following steps may include:

1. Starting with a single strand of wire 40, fold the wire generally in half, leaving two end-points down (a, b), and the folded area illustrated as positioned at the top end 23 of the block 22 and as up for the illustration.

2. Drape the fold in the wire 40 over the coil former block 22, and if optionally included, with the area of greater spacing 36 in the coil former 10 at the bottom end 37 of the block 22, as illustrated of FIG. 12. This step establishes a center of a coil. The coil will be wound from the center 33 of the coil outward.

3. Place tension on the wire (a-b) with respect to the coil former block 22 to allow the folded wire to be pulled into the inner-most diameter of the angled feature in the coil former 10. The wire portion 42 (herein illustrated on the left side of the block 22 using tick marks on that portion of the wire earlier designated an "a." This effectively establishes a first turn 42 of the coil 34, illustrated with reference to FIG. 12A.

4. Taking the "b" end of the wire 40, (location 43 in the illustration) on the right side of the block 22, wind around the coil former block 22 (herein clockwise), stopping at the area of greater spacing 36 or continuing beyond to again at the area of greater spacing. This effectively establishes a second turn 44 of the coil 34, as illustrated with continued reference to FIG. 12A.

5. By way of non-limiting example, take the opposite end of wire (for example the "a" end) and wind one revolution around the coil former 12, going the opposite direction (for example counter clockwise), crossing over the earlier wound b portion at the area of greater spacing 36. Note that this strand 46 will automatically be forced to ride directly on top of turn one and to the side of turn two, as illustrated with reference to FIG. 14.

6. Continue to alternate ends of wire and winding directions, effectively repeating steps 4 and 5 above, until you have gotten to the number of turns desired for the coil.

7. Providing a bonding treatment if not using self-bonding wire. This step may not be needed if the coil is to be used while in the former.

8. Optionally, the coil 34 may then be removed from the coil former 10 as earlier described and as further illustrated with reference to FIG. 12B. By way of example, the turns at the block top 23 are herein identified as 1*a*, 2*b*, 3*a*, and 4*b* in FIG. 12A.

Note that for coils with many turns, the two ends (end "a" and end "b") may be wound onto conventional wire spools. Then, during the winding process, the wire will be delivered from the spools to the coil former. This would be especially handy for machines which incorporate a winding method according to the teachings of the current invention.

Figure 12:
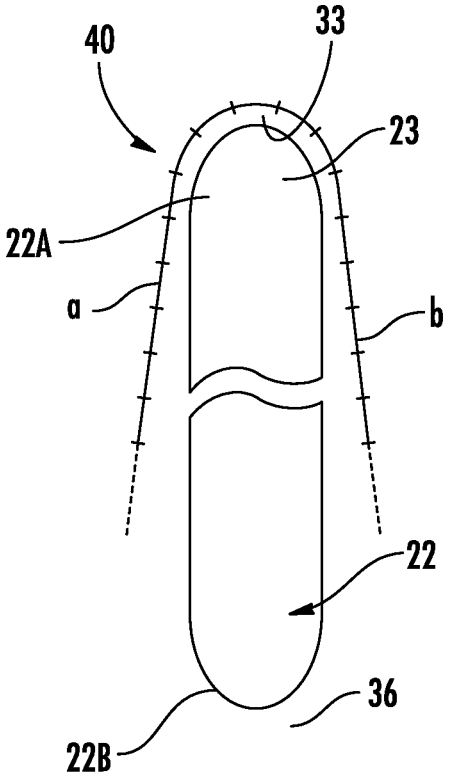
FIG. 12 is a diagrammatical illustration of a length wire positioned in a coil former in preparation for forming a coil according to the teachings of the present invention.
Figure 12A:
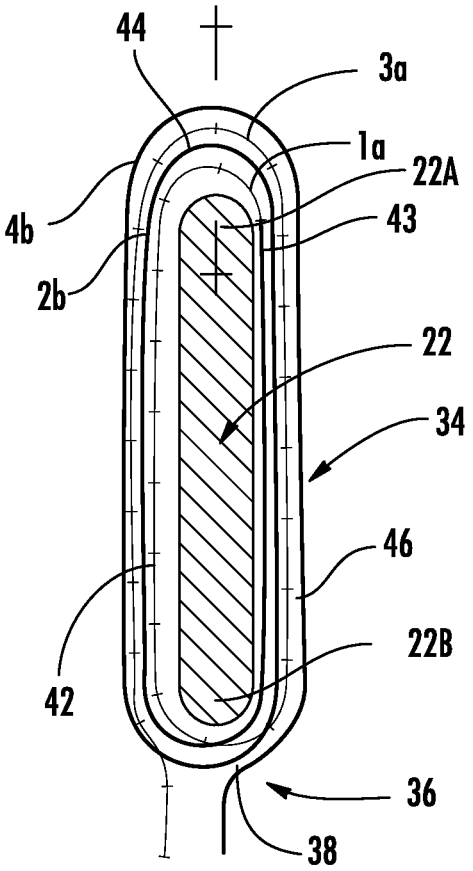
FIG. 12A is a diagrammatical illustration of the wire of FIG. 12 having been wound to partially or fully form a coil according to the teachings of the present invention.
Figure 12B:
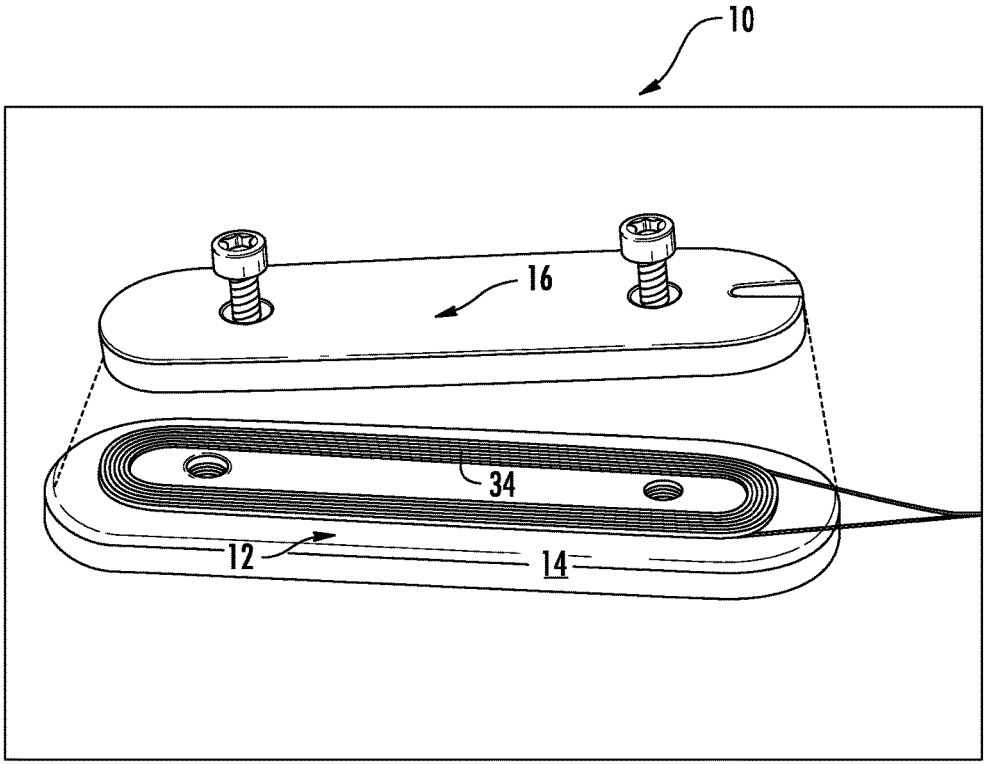
FIG. 12B is an exploded perspective view of one coil having been formed in the coil former and ready for removal therefrom after separating one plate from an opposing plate of the coil former.

By way of further example and with reference to FIGS. 9, 12 and 12A, a method aspect may be described for forming the coil 34 using the coil former 10 having a first side wall 14 in spaced relation to an opposing second side wall 18, wherein the cavity 20 is formed and dimensioned for receiving multiple turns of wire forming the coil 34, and the block 22 is fixed between the side walls, wherein a peripheral wall surface 32 of the block is tapered from one end 22A to an opposing end 22B thereof and from surfaces of the first side wall 14 inwardly toward the opposing second side wall 18. The method comprises providing a single strand of wire 40; folding the strand of wire 40 around one tapered end portion 22A of the block 22 while leaving first and second ends ("a" and "b" as illustrated with continued reference to FIG. 12)

of the strand of wire 40 extending outwardly from the block 22; placing tension on the strand of wire 40 and biasing the strand of wire against the one end 22A of the tapered block; winding the first end "a" of the strand of wire 40 counter-clockwise toward the block opposing end 22B to place the first end "a" of the strand of wire 40 against an inner most tapered portion of the block 22 so and thus form turn one of the coil; winding the second end "b" of the strand of wire 40 clockwise toward the block opposing end 22B stopping proximate the opposing end of the block, thus establishing turn two of the coil 34 and a first layer for the coil (for a two column coil by way of example); winding of the first end "a" of the strand of wire 40 counterclockwise one revolution around the block 22, wherein the first end of wire "a" crosses over the second end "b" of the strand of wire 40 at a designated area proximate the opposing end 22B of the block; continuing to wind the first and second ends (a, b) of the strand of wire 40 in an alternating counterclockwise and clockwise manner until a preselected number of turns is reached. As will come to the mind of those skilling in the art, now having the benefit of the teachings of the present invention, starting turns of wire may be initiated with clockwise or a counterclockwise rotations of the strand of wire 40 as long as the sequence of first end and second end turning is alternated. The above steps are herein presented by way of non-limiting example.

If the resulting coil is intended to be self-supporting, then in order to retain the shape of the coil after it is wound, an adhesive may be applied to the outside of the coil, or the coil wire itself may be made from "self-bonding magnet wire", whose bonding action is activated by either solvent or by heat. A coil resulting from the above steps is as illustrated with reference again to FIG. 7. Alternatively, if the coil is not intended to be self-supporting, then the coil and the coil former may be maintained and used as a single assembly.

By way of example and with reference again to FIG. 7, note that the finished coil 34 indeed has a high copper packing density of an ortho-cyclic coil. However, a width 35 is maintained all the way around the coil circumference 39, and there is no undesirable bulging as is the case with typical ortho-cyclic coils. This is because the above described area of greater spacing 36 in the coil former 10 allows the crossover 38 from column to column to take place in a preselected thickness domain of the coil, rather than the width-domain, as is the case with prior art coils. Like the ortho-cyclic coil, the crossovers are located at a single location in the winding circumference. However, when an "area of greater spacing" is used on the coil former, the cross-over will be taking place in the thickness-domain of the coil. Thus, for the coil shown in FIG. 8, there is an area of the coil where the thickness increases from a nominal 1.866 times that of a single wire diameter, to 2 times (i.e. twice) that of a single wire diameter. Clearly this is an increase that is easily tolerated by the motor or actuator. Moreover since the width is maintained all the way around the coil, and the thickness increases only slightly in the cross-over location, heat sharing among turns is maximized. In addition, since both lead wires are located on the exterior of the coil, no additional thickness is needed to accommodate the lead wires, as is the case with conventional and ortho-cyclic-wound coils which start one lead in the inner-most radius and wind their way outward in a spiral fashion. The winding process is also considerably simpler and therefore more desirable than typical ortho-cyclic winding since alternating the winding ends of the coil and winding directions simply makes each turn of wire fall into the next smaller winding diameter which is created either by earlier turns of wire, or by the coil former itself.

Figure 13:
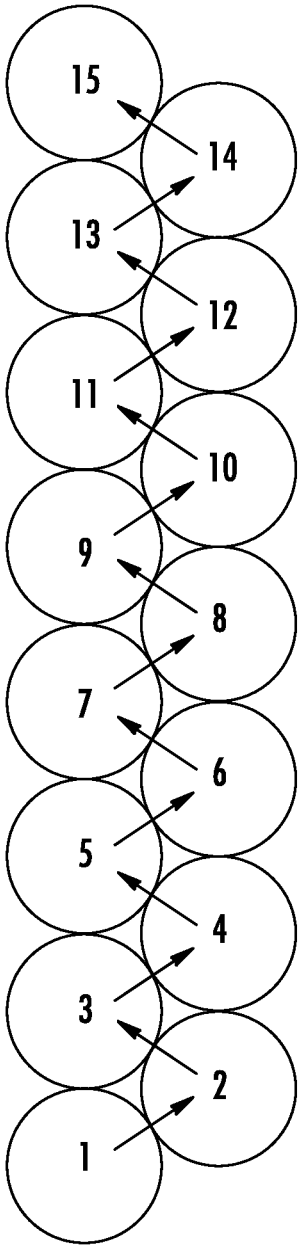
FIG. 13 illustrates the coil of FIG. 8 wound using an ortho-cyclic approach, with turn numbers identified along with arrows showing the direction that each next wire must go in order to create the coil.
Figure 14:
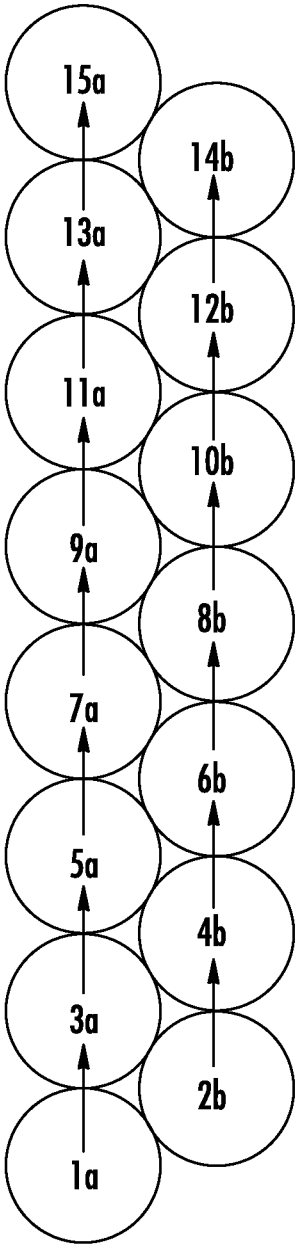
FIG. 14 illustrates the coil of FIG. 8, wound using the method of the current invention, with turn numbers identified along with arrows showing the direction that each wire must go in order to create the coil.

By way of further example, FIG. 13 identifies the turns along with the direction from turn to turn for one coil having an ortho-cyclic winding, wherein FIG. 14 illustrates the same coil but for the coil created using the above described method. By way of illustration, FIG. 14 designates numbers and letters, such as 1*a*, 2*b*, 3*a*, 4*b*, and the like, wherein number designation represents the turn of wire and the letter designation represents the end of the wire that as wound according to the above method.

Figure 15:
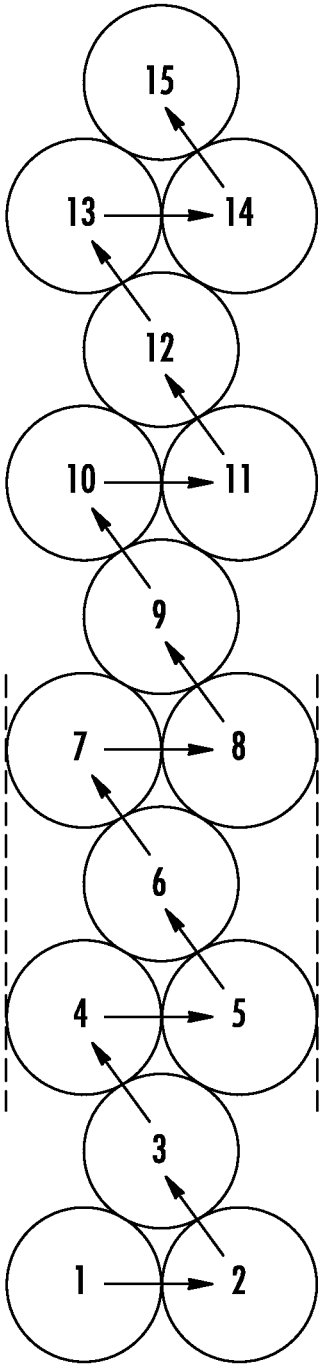
FIG. 15 illustrates a coil having an alternating "two-one" column arrangement, wound using a conventional ortho-cyclic approach, with turn numbers identified along with arrows showing the direction that each next wire must go in order to create the coil.

The invention may be used to create coils with more than two columns of wire, above described by way of non-limiting example, and indeed, when coils having more than two columns are fabricated, the coil former may not include the optional areas of greater spacing as will become clear to those of skill in the art now having the benefit of the teachings of the present invention. By way of continued example, one embodiment of a coil is illustrated with reference top FIG. 15 illustrating a coil in which the number of columns of wire alternates between two and one as each next row (layer) is formed. Since two turns are used for the layer on the inner-most radius, followed by a single turn on the next layer, followed by two on the next layer, and the like, the coil is herein referred to as a "two-one coil." For the two-one coil shown in FIG. 15, the conventional method would teach a coil former with a flat bottom whose side walls are spaced precisely two wire diameters apart. Turns of wire would then wound from the inner-most radius to the outer-most radius, in a spiral fashion, with the winding proceeding in an oscillating fashion from left to right, and then back to the left, and so on.

Figure 16:
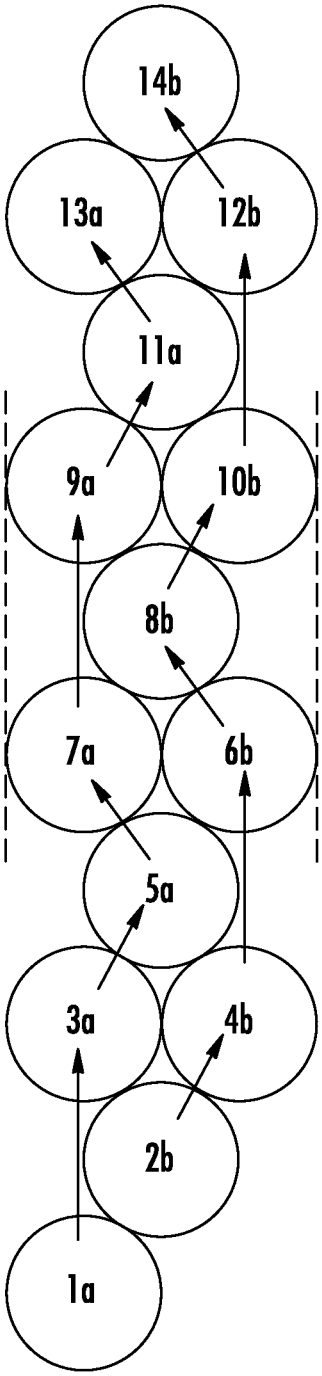
FIG. 16 illustrates a coil having an alternating "two/one" column arrangement, wound using the method of the current invention, with turn numbers identified along with arrows showing the direction that each wire must go in order to create the coil.

In contrast, FIG. 16 illustrates a two-one coil fabricated according to the teachings of the present invention, wherein numbers and letters including 1*a*, 2*b*, 3*a*, 4*b*, and the like are illustrated. As earlier described, the number represents the turn of wire and the letter represents the end of the wire that is wound, as earlier described with reference to FIGS. 12 and 12A. As described in method steps (Step 1 through Step 6) above, a single strand of wire is used, and turn number 1 is formed by draping the length of wire over the coil former, allowing the center of the strand of wire to form turn 1, and then each subsequent turn of wire is wound using alternating ends of the strand of wire. For example, if turn number 2 is wound clockwise using the "b" end of the wire, then turn number 3 would be wound counter-clockwise using the "a" end of the wire. Turn number 4 is then wound clockwise using the "b" end of the wire, and then turn number 5 would be wound counter-clockwise using the "a" and of the wire. Since the coil former, as above described, has the angled feature, it forces turn number 1 to be at the inner-most radius of the coil, and also forces turns 2 and 4 to be desirably placed for all other turns to follow. As above described, when it comes time to remove the coil after it has been wound, the removal is very easy because of the angled nature of the first few turns. The angled feature of the coil former rather than a flat inner surface allows the coil to easily pop off the coil former.

Looking at the difference between FIG. 15 and FIG. 16, it can be seen that the method teachings of the present invention may result in a coil with fewer turns for a given winding width (14 versus 15) because of the angled nature of the coil former which forces the first few turns into place, easing subsequent winding. However, the smaller number of turns is generally easily tolerated within practical applications, and is desirable with respect to the easier coil winding process, and reduced bulging in the cross-over areas.

Figure 17:
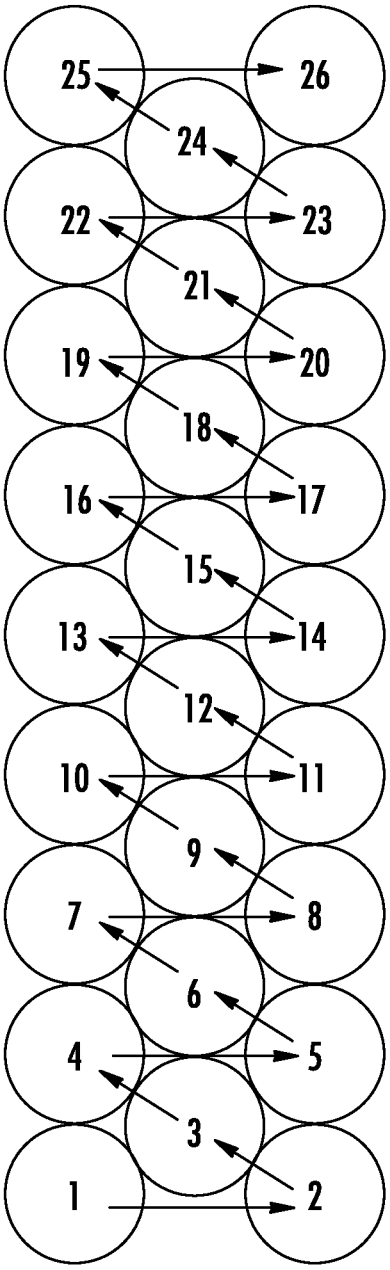
FIG. 17 illustrates another coil having an alternating "two/one wide" column arrangement, wound using a conventional ortho-cyclic approach, with turn numbers identified along with arrows showing the direction that each next wire must go in order to create the coil.

By way of further non-limiting example, FIG. 17 illustrates a coil wound using a conventional ortho-cyclic approach. As herein described, this type of coil is a "two-one wide coil", because two turns are used for the layer on the inner-most radius, followed by a single turn on the next layer, followed by two on the next layer, etc. This coil is different from the two-one coil shown in FIG. 15 because the spacing between the first and second turn is made wider (hence a wide spacing designation), allowing turn 3 to fall in between turns 1 and 2, and allowing all subsequent turns to stack on top of each other. This type of coil clearly allows much greater copper packing density and is thus more desirable. Based on known teachings, this type of coil is relatively difficult to create for known ortho-cyclic coils because the transition between turn 1 and 2 must be made completely across the entire coil former side wall spacing, as does turn 4 and 5, turn 7 and 8, etc. Thus, the most optimal copper packing is difficult to achieve using ortho-cyclic techniques.

Figure 18:
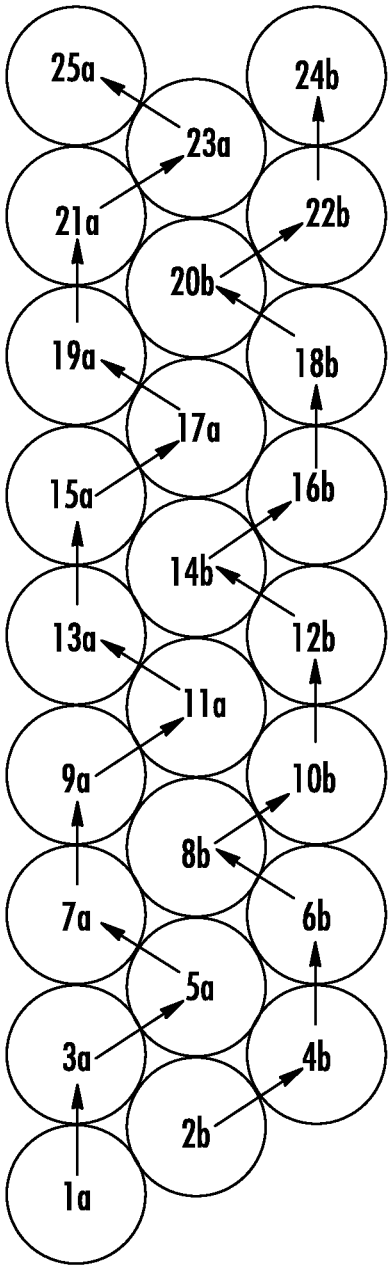
FIG. 18 illustrates another coil having an alternating "two/one wide" column arrangement, wound using the method of the current invention, with turn numbers identified along with arrows showing the direction that each wire must go in order to create the coil.

By way of contrast based on the teachings of the present invention, FIG. 18 illustrates the two-one coil of FIG. 17 and how it may be wound using the method teachings of the present invention. Again, because of the angled coil former, the first few turns fall right into place, as desired. However, because of the alternating clockwise, counter-clockwise winding of subsequent turns from opposite ends of the strand of wire, this method of the current invention makes this type of coil very easy to fabricate.

Figure 19:
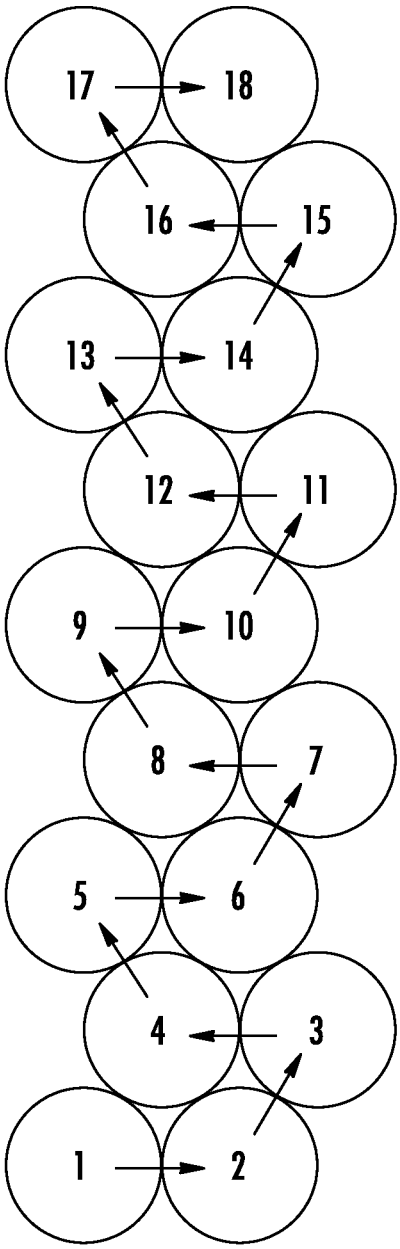
FIG. 19 illustrates a coil having an alternating "two/two" column arrangement, wound using a conventional ortho-cyclic approach, with turn numbers identified along with arrows showing the direction that each next wire must go in order to create the coil.

With yet further illustration, FIG. 19 illustrates another coil wound using a conventional, known, ortho-cyclic approach. This type of coil is herein referred to as a "two-two coil". The winding process is similar to the coil shown in FIG. 15, as are the drawbacks of the typical ortho-cyclic approach.

Figure 20:
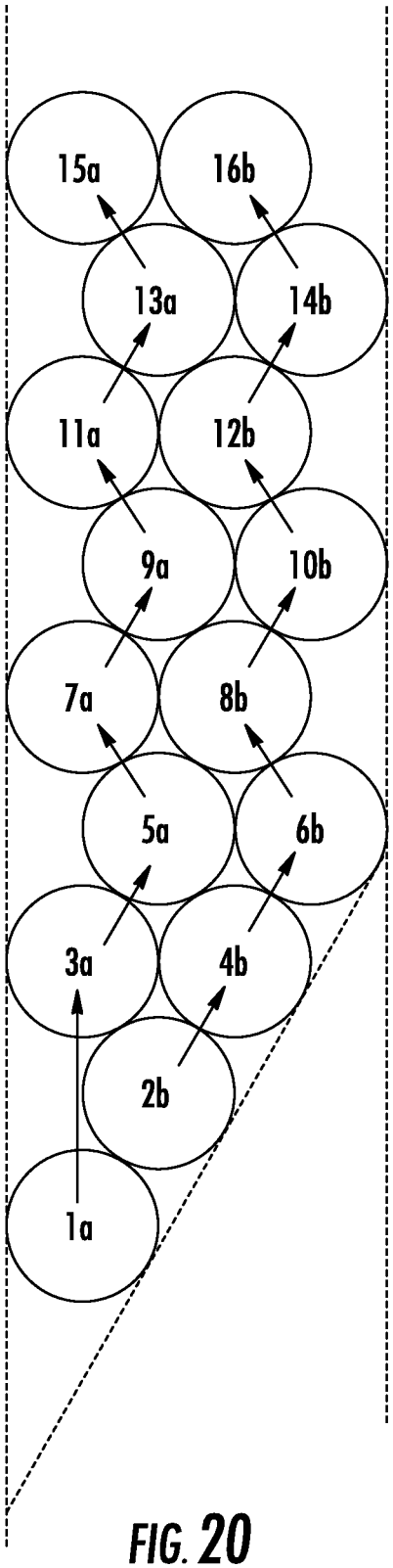
FIG. 20 illustrates a coil having an alternating "two-two" column arrangement, wound using the method of the current invention, with turn numbers identified along with arrows showing the direction that each wire must go in order to create the coil.

FIG. 20 illustrates how the two-two coil may be created using a method according to the teachings of the present invention.

Figure 21:
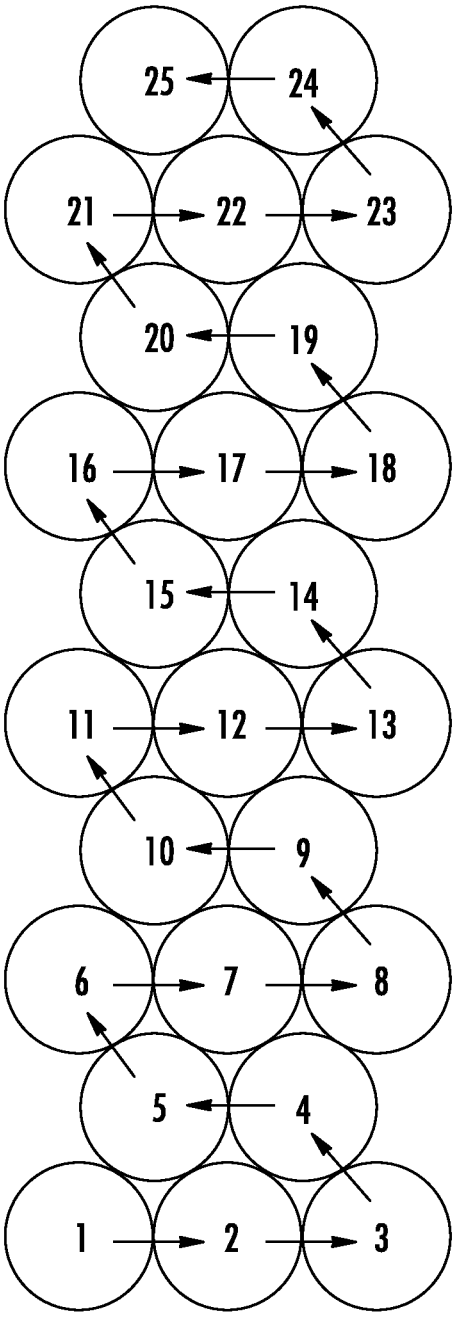
FIG. 21 illustrates a coil having an alternating "three/two" column arrangement, wound using a conventional ortho-cyclic approach, with turn numbers identified along with arrows showing the direction that each next wire must go in order to create the coil.

FIG. 21 illustrates another coil wound using a conventional ortho-cyclic approach. This type of coil is herein referred to as a "three-two coil". The winding process is similar to the coil shown in FIG. 15 and FIG. 19, as are the drawbacks of the known ortho-cyclic approaches.

Figure 22:
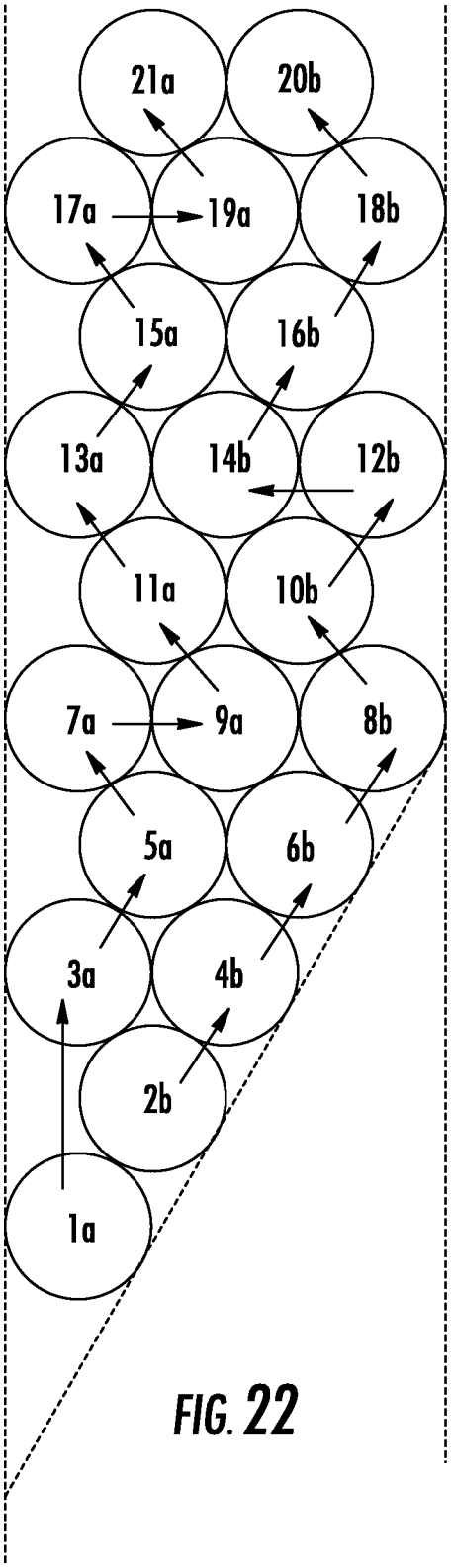
FIG. 22 illustrates a coil having an alternating "three/two" column arrangement, wound using the method of the current invention, with turn numbers identified along with arrows showing the direction that each wire must go in order to create the coil.

FIG. 22 illustrates how a three-two coil may be created using a method according to the teachings of the present invention.

Figure 23:
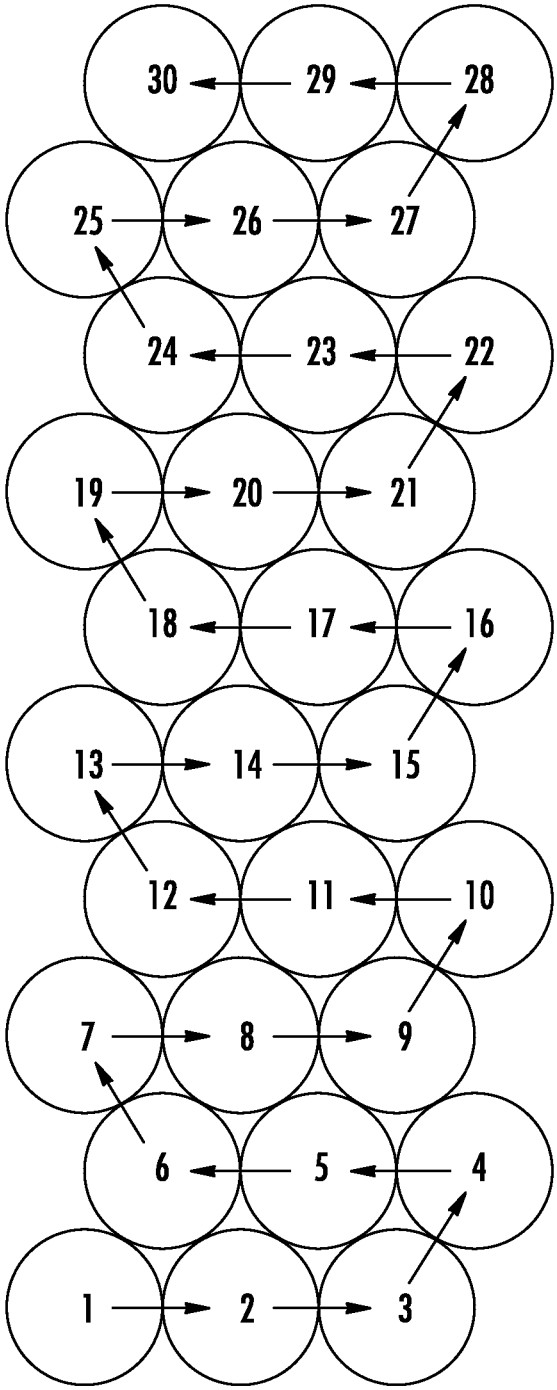
FIG. 23 illustrates a coil having an alternating "three/three" column arrangement, wound using a conventional ortho-cyclic approach, with turn numbers identified along with arrows showing the direction that each next wire must go in order to create the coil.

FIG. 23 shows another coil wound using a conventional ortho-cyclic approach. This type of coil is referred to as a "three-three coil". The winding process is similar to the coil shown in FIG. 15 and FIG. 19 and FIG. 21, as are the drawbacks of the typical ortho-cyclic approach.

Figure 24:
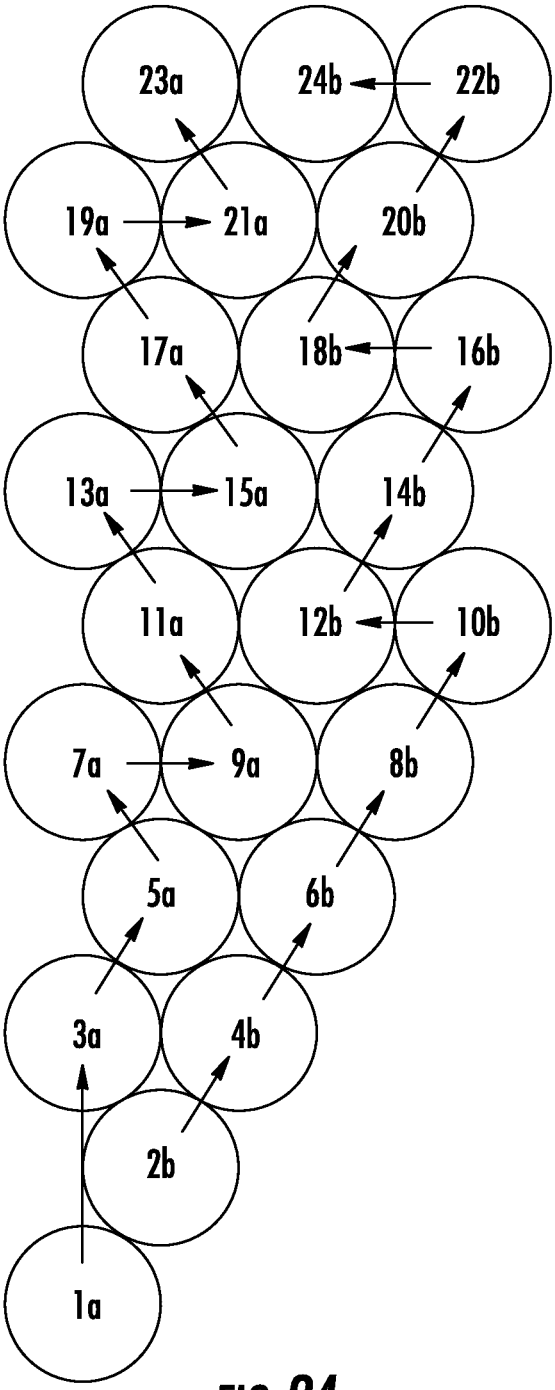
FIG. 24 illustrates a coil having an alternating "three/three" column arrangement, wound using the method of the current invention, with turn numbers identified along with arrows showing the direction that each wire must go in order to create the coil.

FIG. 24 illustrates how a three-three coil may be created using a method according to the teachings of the present invention.

Figure 25:
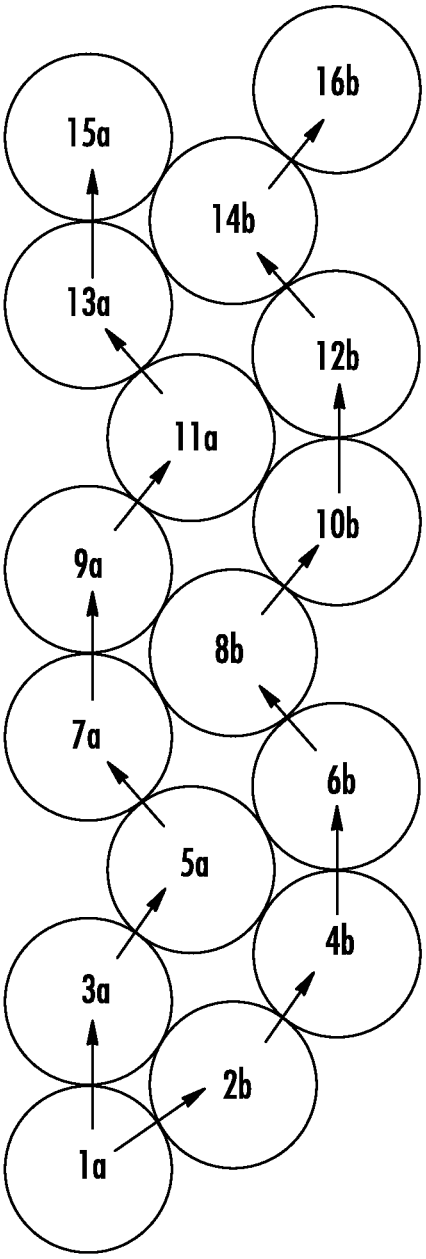
FIG. 25 illustrates a coil having an alternating "two/one wide" column arrangement, but one where the walls of the coil former are not wide enough to fully accommodate the width needed for a "two/one wide" coil, with turn numbers identified along with arrows showing the direction that each next wire must go in order to create the coil.

FIG. 25 shows a coil similar to that of FIG. 18, but where not enough spacing is provided between the walls of the coil former to fully accommodate the turns of wire. FIG. 25 illustrates that even when the coil former width is not set correctly, the invention will work effectively, and still provide a coil with the most optimal packing possible. Note that even though this coil is not "fully" packed, it still may be beneficial for applications that are trying to include a certain number of turns in a fixed amount of space.

Figure 1:
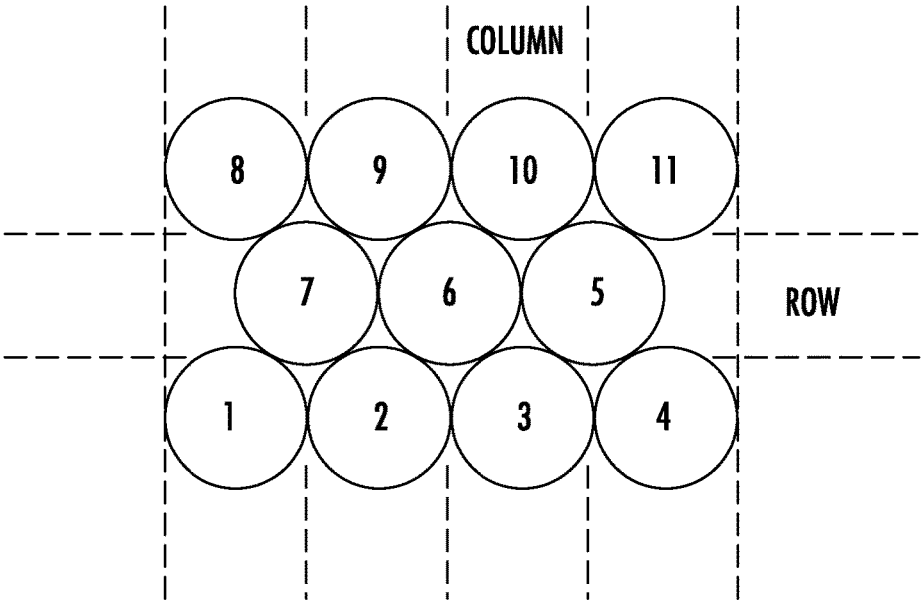
FIG. 1 is a diagrammatical cross sectional illustration of turns of wire nested in a coil, wherein each turn on each row is wound right next to an adjacent turn.
Figure 2:
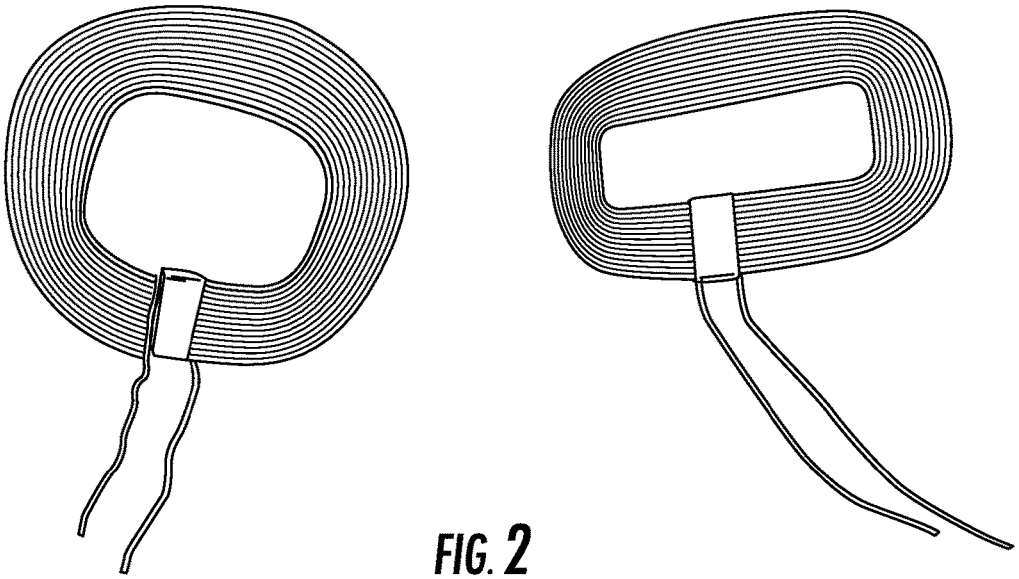
FIG. 2 illustrates perspective views of electrical coils having a generally rectangular inner shape yet rounded outer shape resulting from cross-over patterns formed during the winding.
Figure 1A:
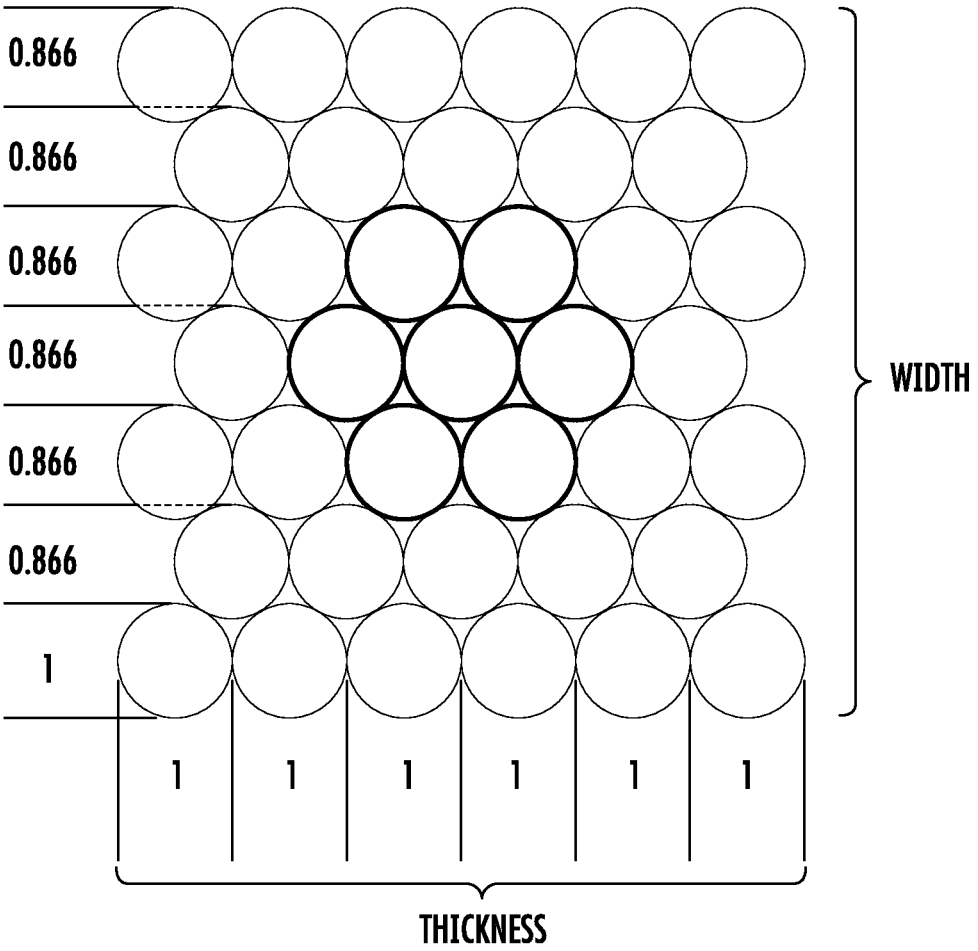
FIGS. 1A-1E include cross sectional views of coils illustrating various coil winding configurations, and a hexagonal pattern resulting from observations and teachings of the present invention, by way of example.
Figure 1B:
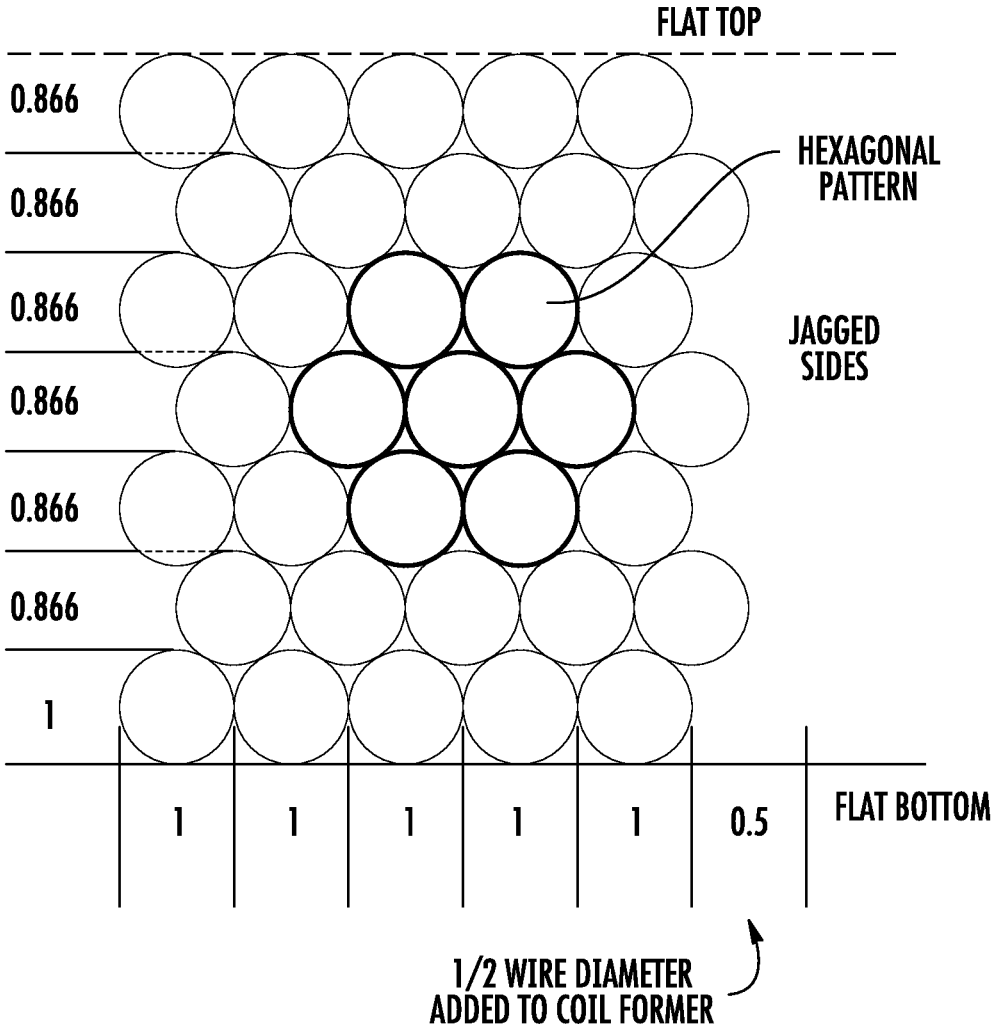
Figure 1C:
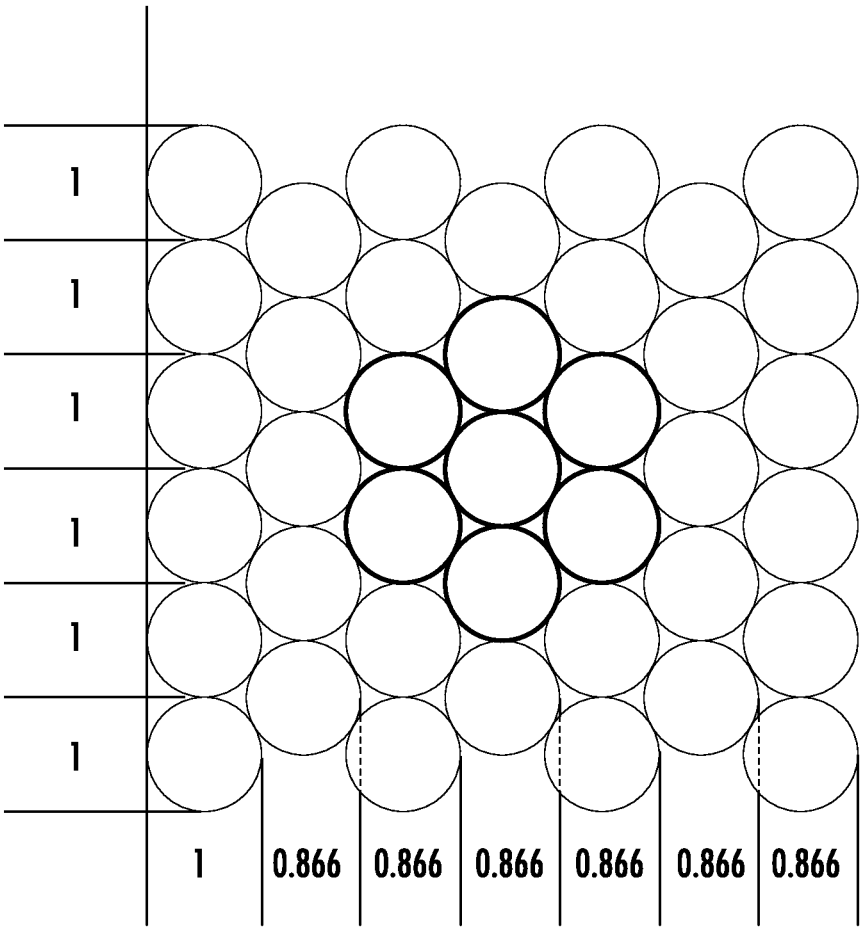
Figure 1D:
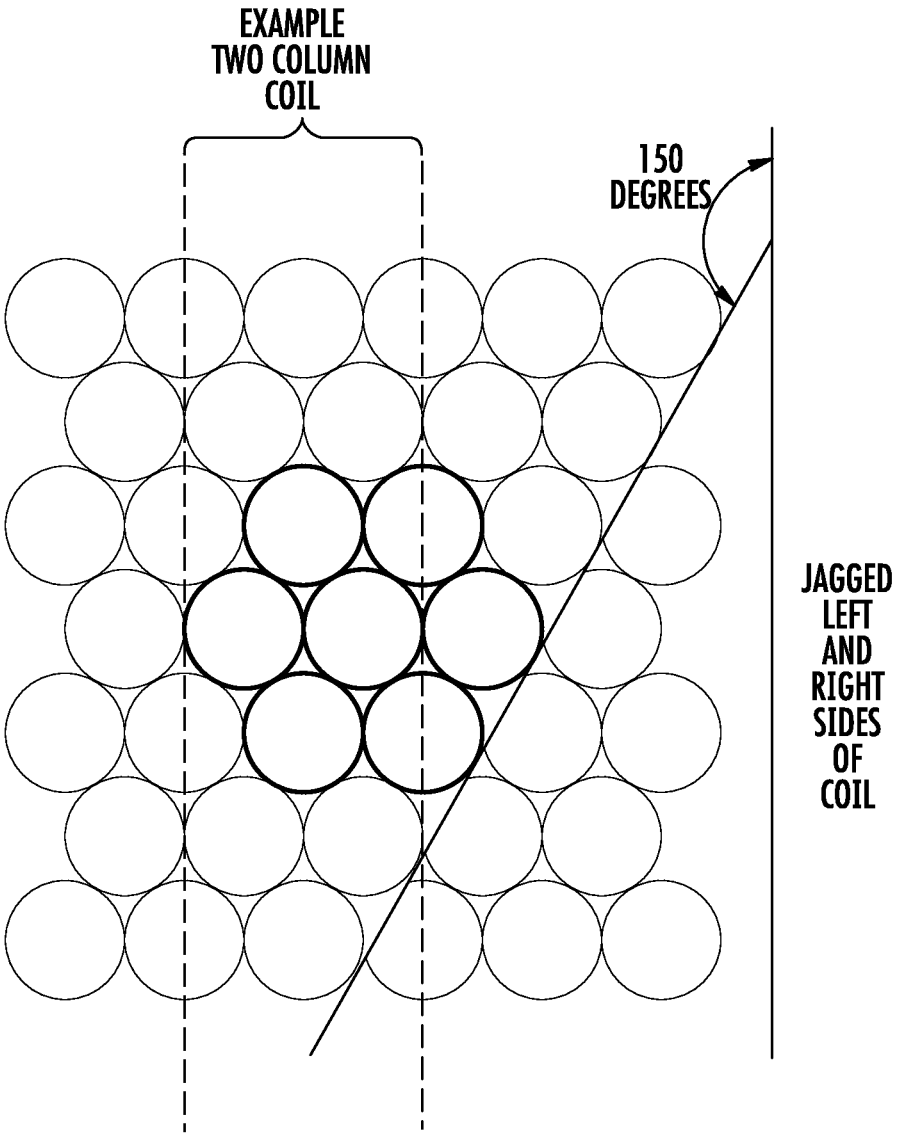
Figure 1E:
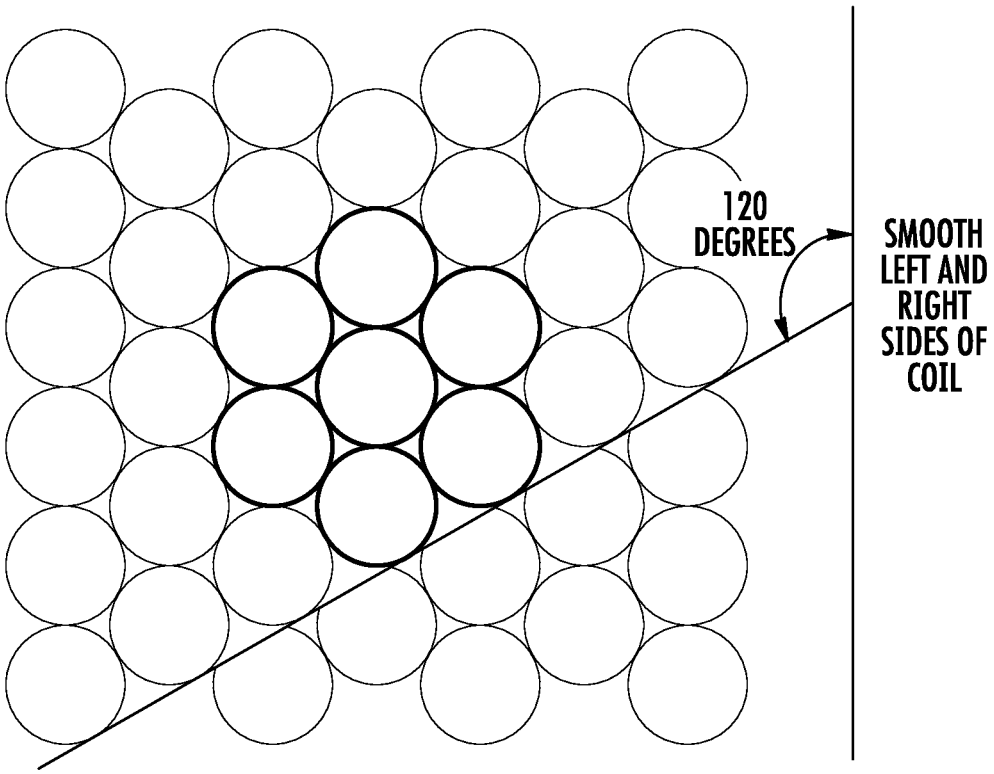
Figure 3:
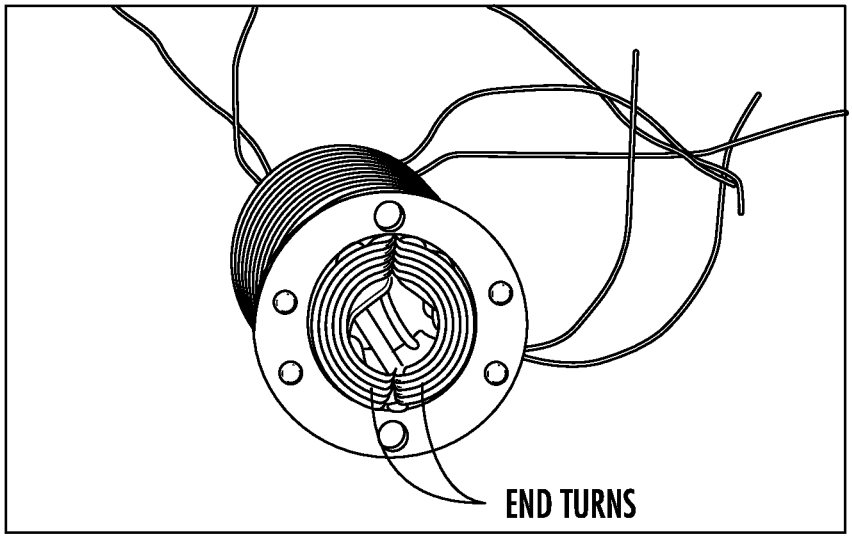
FIG. 3 is a perspective end view of a slotted motor illustrating coils with turn-around areas being folded over an outside portion of slots.
Figure 4:
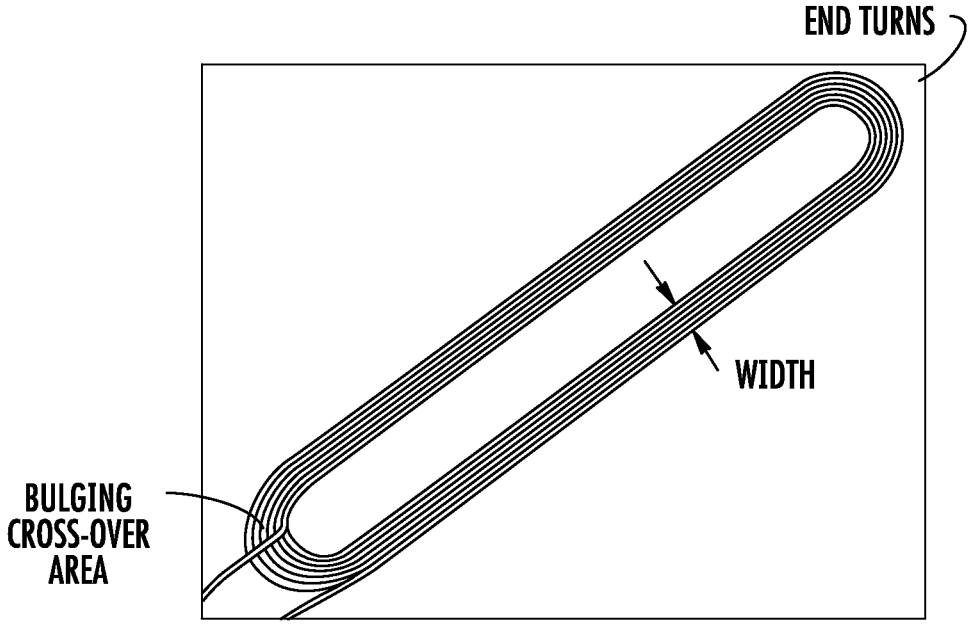
FIG. 4 PRIOR ART
FIG. 4 illustrates a known coil having turns nested around a circumference of the coil, except at one end (left/bottom side) where cross-over points are located and a bulge results where wires cross over each other.
Figure 5:
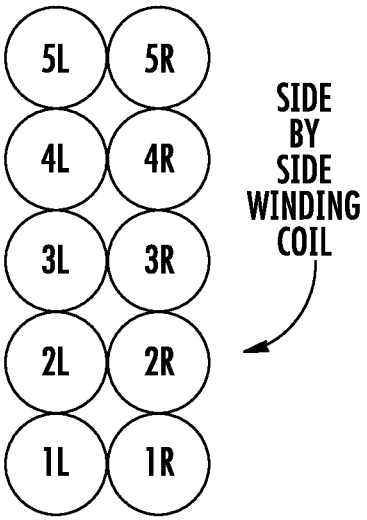
FIG. 5 PRIOR ART
FIG. 5 is a cross sectional view illustrating a well-known coil packing arrangement, wherein bulging is eliminated.
Figure 6:
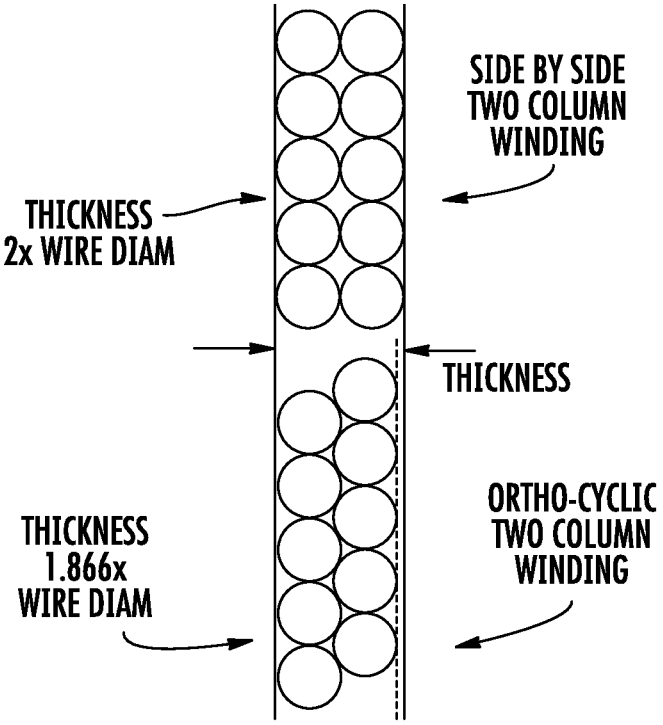
FIG. 6 illustrates a comparison between a two-column coil wound in a side-by-side fashion and in an ortho-cyclic fashion.

With reference again to FIG. 7, by way of example, note that all coils wound using the method of the current invention result in both lead wires ending on the outer-most radius of the coil, rather than one lead wire on the inner-most radius and the other on the outer-most radius, as illustrated with reference again to FIG. 4. As will be appreciated by those of skill in the art, such a feature is desirable in many coil applications.

While the angled feature of the coil former has been illustrated with selected shapes and angles, by way of example, it is interest to note that the angle used on the coil former may need to be changed in order to obtain a desired number of turns and alternation of turns between layers. Coils shown in FIG. 14, FIG. 18 and FIG. 25, by way of example, have a high degree of copper packing, and are created with coil former features having an angular relationship of the 120 degrees with respect to the side-wall. As noted above, 120 degrees is used because the left and right sides of the coil are relatively flat. By contrast, coils shown in FIG. 16, FIG. 20, FIG. 22 and FIG. 24 have a normal degree of copper packing are created with coil former features having an angular relationship of 150 degrees. As noted above, 150 degrees is used when it is desirable for the left and right sides of the coil to be "jagged", and the top of the coil to be relatively flat.

As above described, the coil former above described may be used to aid in creation of ortho-cyclic coils. With reference again to FIG. 21, one coil is illustrated that has been wound using conventional techniques. This is not to say that a coil wound using convention techniques is prior art with respect to the coil structure. For the typically known ortho-cyclic approach, the position of the turns on the first layer is critical, in order to ensure that all other turns will follow the initial pattern. Moreover, this winding process must proceed very slowly and carefully to ensure that all cross-over locations are restricted to a single area. Finally, when it comes time to remove the coil after it has been wound using known techniques, it is difficult because of the flat-bottom nature of conventional coil formers.

Figure 26:
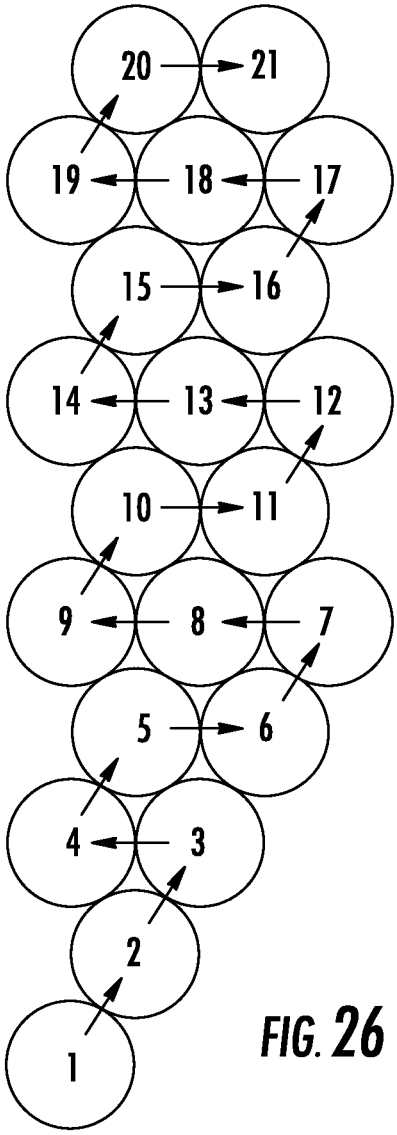
FIG. 26 is a cross sectional view of one coil wound using one embodiment of a coil former of the present invention illustrated by way of non-limiting example.

With reference now to FIG. 26, a coil wound using one possible embodiment of the coil former of the present invention is illustrated by way of yet another non-limiting example. Since the coil former has an angled bottom created by a conical surface, the first few turns as well as the cross-over transition from turn to turn is precisely enforced by the conical nature of the former relative to the side walls.

Note that the coil is still wound using a left-to-right and then right-to-left cyclical nature, but the location of the first six turns is very precisely controlled by the angled bottom surface. Because of this, an ortho-cyclic coil can be much more easily created using this invention.

Figure 27:
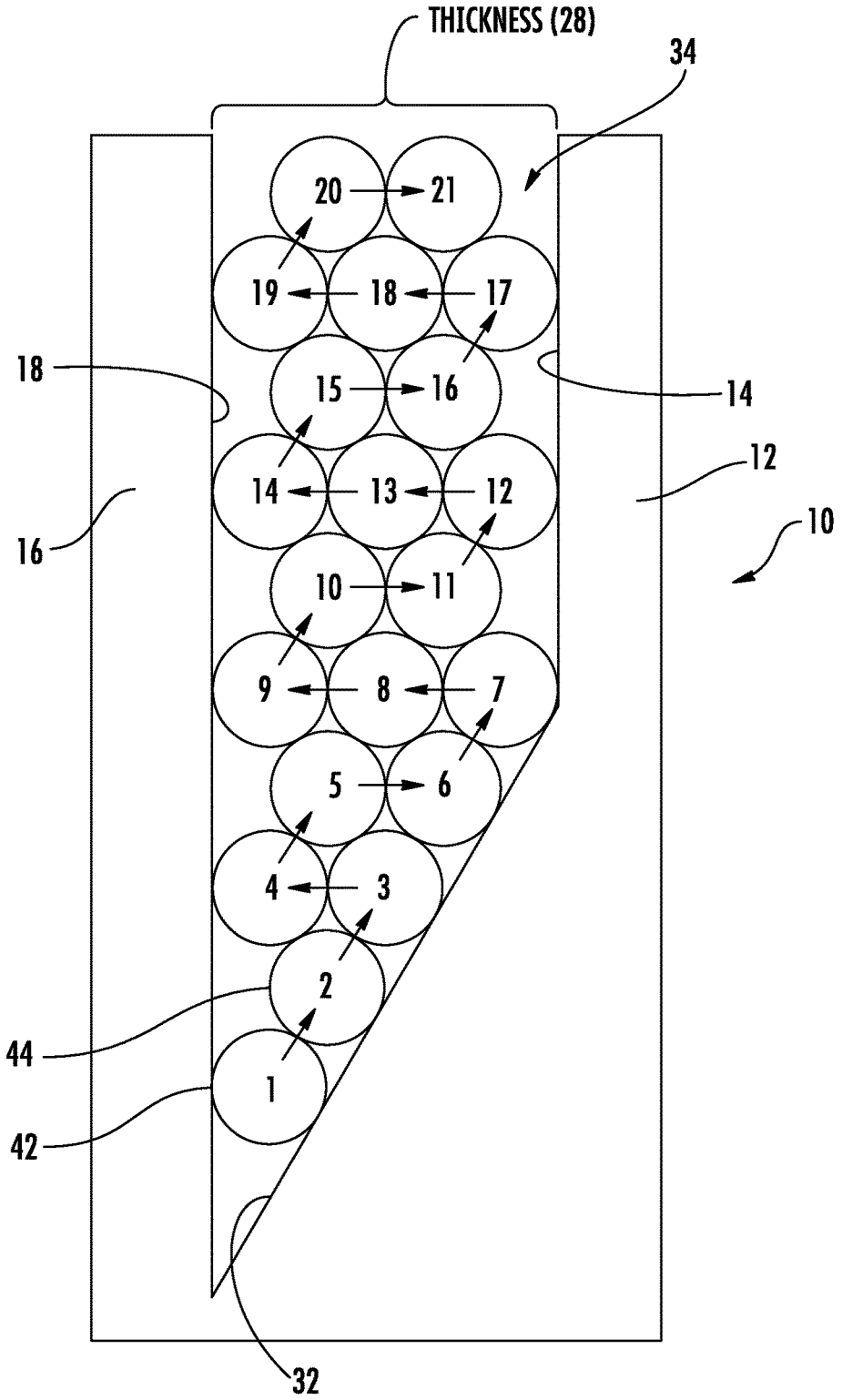
FIG. 27 is a partial diagrammatical illustration of a coil former used to create the coil of FIG. 26 and illustrating a positioning of the coil of FIG. 26 therein.

With reference to FIG. 27, a coil former used to create the coil shown in FIG. 26 is illustrated with left side-wall, right side-wall, and angled bottom shown. In addition, how the turns fit within the side-walls and angled bottom during the winding process is illustrated, by way of non-limiting example.

Note that in addition to being usable with the conventional spiral winding technique (whether ortho-cyclic or not and with or without the area of greater spacing in the former), the coil former embodiments of the invention, herein described by way of example, may be used with the alternative winding technique described above. With the alternative winding technique, two ends of the coil wire are wound alternately, with one end wound clockwise, and the other end wound counter clockwise, one after another. Each end of the wire is identified as either "a" or "b". So for example end "a" is wound counter-clockwise, while end "b" is wound clockwise, as illustrated with reference again to FIG. 22. As earlier described with reference to FIG. 7, one of the benefits of this coil winding technique is that when the coil is completely wound, both ends will reside on the outer radius of the coil, whereby with a conventional coil, one of the ends is at the inner-most radius and the other is at the outer radius.

Note that the coil former of the present invention may be embodied as a single piece, for example as a "bobbin" around which the coil is wound to form a coil/former assembly, for use in a transformer, motor, or other appliance. Alternatively, the coil former may be embodied in multiple pieces, as above described, for example one piece forming the left side-wall, one piece forming the right side-wall, and one piece forming the angled bottom (or inner-radius establishing wall). Likewise it is possible that the angled bottom may be an integral part of one side-wall. As will be appreciated by those of skill in the art, the multi-piece coil former is particularly useful for winding self-supporting coils.

Although the invention has been described relative to various selected embodiments herein presented by way of example, there are numerous variations and modifications that will be readily apparent to those skilled in the art in light of the above teachings. It is therefore to be understood that, within the scope of the claims supported by this specification, the invention may be practiced other than as specifically described.

That which is claimed is:

1. A coil former comprising:

a first side wall in spaced relation to an opposing second side wall, wherein a cavity is formed therebetween and dimensioned for receiving multiple turns of wire for forming a coil therein; and a block fixed between the opposing first and second side walls, wherein a peripheral wall surface of the block is tapered from the first side wall to the opposing second side wall, and wherein at least one of the first and second side walls includes a channel formed outwardly from the tapered surface to provide an area of greater spacing than the spaced relation, the area of greater spacing sufficient for accommodating a cross-over portion of a coil formed within the cavity.

2. The coil former according to claim 1, wherein the channel includes a slot proximate an end portion of the block, the slot contributing to the area of greater spacing.

3. The coil former according to claim 1, wherein the tapered block comprises an angle of taper forming the tapered surface of at least one of 120 degrees and 150 degrees.

4. The coil former according to claim 1, wherein the block is integrally formed with the first side wall, and wherein the second side wall is removably attached to the block for slidably removing a coil formed within the cavity upon removal of the second side wall.

5. The coil former according to claim 1, wherein the block includes arcuate surfaces at opposite end thereof.

6. The coil former according to claim 1, wherein the block comprises an elongate block aligned along a long axis of the side walls and includes arcuate surfaces within the long axis and at opposite ends thereof.

7. The coil former according to claim 1, further comprising means for securing the first plate to the second plate while centering the block therebetween.

8. The coil former according to claim 7, wherein the securing means comprises a bolt removably securing the second side wall to the block and wherein the first side wall is fixedly secured to the block.

9. A coil former comprising:

a first plate having a first side wall surface;

a second plate having a second side wall surface; and a block positioned within peripheries of and between the first and second plates for fixing a space between the first and second side wall surfaces, wherein a peripheral wall surface of the block extending from the first side wall surface to the second side wall surface is tapered and includes tapered arcuate surfaces at opposite ends thereof, and wherein one of the opposing plates and is removably secured to the block for slidably removing a coil formed within the coil former upon removal of the one plate.

10. The coil former according to claim 9, wherein the plates comprise elongate plates and the block is fixed centrally along a long axis of the elongate plates.

11. The coil former according to claim 9, wherein the block is integrally formed with at least one of the first and second plates and fixedly secured thereto.

12. The coil former according to claim 9, wherein the spacing between the opposing side walls is uniform except for at least one area of greater spacing formed between the opposing side walls is sufficient for accommodating a cross-over portion of a coil being formed between the opposing side walls.

13. A method of forming a coil using a coil former having a first side wall in spaced relation to an opposing second side wall, wherein a cavity is formed therebetween and dimensioned for receiving multiple turns of wire for forming the coil therein, and a block fixed between the opposing first and second side walls, wherein a peripheral wall surface of the block is tapered from one end to an opposing end thereof and from the first side wall inwardly toward the opposing second side wall, the method comprising:

providing a single strand of wire;

folding the strand of wire around one tapered end portion of the block while leaving first and second ends of the strand of wire extending outwardly from the cavity;

placing tension on the strand of wire and biasing the strand of wire against the one end of the tapered block;

winding the first end of the strand of wire in one of a counterclockwise or clockwise selected movement toward the block opposing end to place the first end of the strand of wire against an inner most tapered portion of the block so as to form turn one of the coil;

winding the second end of the strand of wire toward and around the block opposing end in an opposite direction than the first end and making a full revolution stopping proximate the opposing end of the block, thus establishing turn two of the coil and a first layer for the coil;

winding of the first end of the strand of wire in the selected movement through one revolution around the block, wherein the first end of wire crosses over the second end of the strand of wire proximate the opposing end of the block; and continuing to wind the first and second ends of the strand of wire in alternating fashion through their respective selected movements until a preselected number of turns is reached.

14. The method according to claim 13, wherein the clockwise and counterclockwise winding results in the ends of the strands of wire only crossing over each other proximate the opposing end of the block.

15. The method according to claim 14, wherein the cavity formed between spacing between the opposing first and second side walls is uniform along the block except proximate the block opposing end wherein an area of greater spacing is formed, and wherein the winding results in the ends of the strands of wire only crossing over each within the area of greater spacing.

16. The method according to claim 13, further comprising:

separating the first and second side walls such that an inside taper of the block is exposed; and removing the coil from the block.

17. The method according to claim 13, wherein the winding is terminated with the first and second ends of the strand of wire exiting the coil former at a common end thereof.

18. The method according to claim 13, wherein the block has a 150 degree tapered surface receiving the strand of wire, and wherein the winding of the strand of wire provides a coil having generally jiggered sides.

19. The method according to claim 13, wherein the block has a 120 degree tapered surface receiving the strand of wire, and wherein the winding of the strand of wire provides a coil having generally smooth sides.

20. A method of forming a coil using a coil former having a first side wall in spaced relation to an opposing second side wall and a block fixed therebetween, wherein a periphery of the block is tapered inwardly from the first side wall toward the opposing second wall, the method comprising:

providing a single strand of wire;

folding the strand of wire around a first end of the block while leaving first and second ends of the strand of wire extending outwardly therefrom;

placing tension on the strand of wire and biasing the strand of wire against the tapered block;

winding the first end of the strand of wire in one of a counterclockwise or clockwise selected movement toward a second end of the block to place the first end of the strand of wire against an inner most tapered portion of the block;

winding the second end of the strand of wire toward and around the second end of the block in an opposite direction than the first end and making a full revolution stopping proximate an opposing end of the block, thus establishing a first layer for the coil;

winding of the first end of the strand of wire in the selected movement through one revolution around the block, wherein the first end of wire crosses over the second end of the strand of wire proximate the second end of the block; and continuing to wind the first and second ends of the strand of wire in alternating fashion through their respective selected movements until a preselected number of turns is reached.

21. The method according to claim 20, wherein the clockwise and counterclockwise winding results in the ends of the strands of wire crossing over each other only proximate the opposing end of the block.

22. The method according to claim 21, wherein spacing between the first and second side walls is uniform along the former, and wherein proximate the second end of the block an area of greater spacing is formed proximate the second end of the block for receiving the crossover of the first and second ends of the strand of wire.

23. The method according to claim 20, further comprising:

separating the first and second side walls such that an inside taper of the block is exposed; and removing the coil from the block.

24. The method according to claim 20, wherein the winding is terminated with the first and second ends of the strand of wire exiting the coil former proximate the second end of the block.

25. The method according to claim 20, wherein the block has a 150 degree tapered surface receiving the strand of wire, and wherein the winding of the strand of wire provides a coil having generally jiggered sides.

26. The method according to claim 20, wherein the block has a 120 degree tapered surface receiving the strand of wire, and wherein the winding of the strand of wire provides a coil having generally smooth sides.

27. A coil former comprising:

a first plate in spaced relation to an opposing second plate; and a block secured to and between the first and second plates for forming a cavity therebetween, wherein a peripheral wall surface of the block is tapered from the first plate to the opposing second plate including opposite ends of the block having a tapered arcuate surface for receiving multiple turns of wire within the cavity and around the tapered surface of the block for forming a coil therein, wherein an angle of the taper establishes a pattern for wire being wound around the block forming the coil, and wherein a channel is formed within at least one of the first and second plates outwardly from the tapered arcuate surface to provide an area of spacing sufficient for accommodating a cross-over portion of the coil formed within the cavity.

28. The coil former according to claim 27, wherein at least one of the first and second plates is removably attached to the block, and wherein removal of the at least one of the first and second plates allows a slidably removal of the coil away from the block.

* * * * *